US008506105B2

(12) United States Patent
Sharma et al.

(10) Patent No.: US 8,506,105 B2
(45) Date of Patent: Aug. 13, 2013

(54) THERMAL MANAGEMENT SYSTEMS FOR SOLID STATE LIGHTING AND OTHER ELECTRONIC SYSTEMS

(75) Inventors: Rajdeep Sharma, Clifton Park, NY (US); Stanton Earl Weaver, Jr., Broadalbin, NY (US); Glenn Howard Kuenzler, Beachwood, OH (US); Mehmet Arik, Niskayuna, NY (US); Gary Robert Allen, Chesterland, OH (US); Jeffrey Marc Nall, Brecksville, OH (US)

(73) Assignee: Generla Electric Company, Niskayuna, NY (US)

( * ) Notice: Subject to any disclaimer, the term of this patent is extended or adjusted under 35 U.S.C. 154(b) by 64 days.

(21) Appl. No.: 13/212,565

(22) Filed: Aug. 18, 2011

(65) Prior Publication Data

US 2012/0051058 A1 Mar. 1, 2012

Related U.S. Application Data

(60) Provisional application No. 61/376,866, filed on Aug. 25, 2010.

(51) Int. Cl.
*F21V 33/00* (2006.01)

(52) U.S. Cl.
USPC ..... 362/96; 362/234; 362/253; 362/294; 362/373; 310/328

(58) Field of Classification Search
USPC ..... 362/96, 234, 253, 294, 373; 361/694; 310/328; 313/46
See application file for complete search history.

(56) References Cited

U.S. PATENT DOCUMENTS

| | | | |
|---|---|---|---|
| 4,406,323 | A | 9/1983 | Edelman |
| 6,661,167 | B2 | 12/2003 | Eliashevich et al. |
| 6,746,889 | B1 | 6/2004 | Eliashevich et al. |
| 6,769,947 | B1 | 8/2004 | Kuenzler et al. |
| 6,799,864 | B2 | 10/2004 | Bohler et al. |
| 6,864,571 | B2 | 3/2005 | Arik et al. |
| 6,921,929 | B2 | 7/2005 | LeBoeuf et al. |
| 6,964,877 | B2 | 11/2005 | Chen et al. |
| 7,010,930 | B2 | 3/2006 | Arik et al. |
| 7,077,566 | B2 | 7/2006 | Rajendran et al. |
| 7,095,110 | B2 | 8/2006 | Arik et al. |
| 7,119,372 | B2 | 10/2006 | Stokes et al. |
| 7,135,863 | B2 | 11/2006 | Arik et al. |

(Continued)

FOREIGN PATENT DOCUMENTS

| | | | |
|---|---|---|---|
| DE | 102007037862 | A1 | 10/2008 |
| WO | 0044204 | A1 | 7/2000 |
| WO | 2007069213 | A2 | 6/2007 |
| WO | 2008128635 | A1 | 10/2008 |

OTHER PUBLICATIONS

Search Report and Written Opinion from corresponding PCT Application No. PCT/US2011/048710 dated Dec. 15, 2011.

*Primary Examiner* — Stephen F Husar
*Assistant Examiner* — Meghan Dunwiddie
(74) *Attorney, Agent, or Firm* — Mary Louise Stanford

(57) ABSTRACT

An apparatus is provided including at least one electronic component. The apparatus also includes an enclosure enclosing the at least one electronic component. The enclosure includes at least one wall defined by a membrane. The apparatus further includes a piezoelectric actuator that is fixed at a first end and rigidly attached to the membrane at a second end. Application of alternating current to the piezoelectric actuator generates a pulsating mechanical deformation of the membrane.

19 Claims, 14 Drawing Sheets

(56) References Cited

U.S. PATENT DOCUMENTS

| | | | |
|---|---|---|---|
| 7,140,420 | B2 | 11/2006 | Arik et al. |
| 7,147,208 | B1 | 12/2006 | Guida et al. |
| 7,179,670 | B2 | 2/2007 | Shelton et al. |
| 7,201,497 | B2 | 4/2007 | Weaver, Jr. et al. |
| 7,204,615 | B2 | 4/2007 | Arik et al. |
| 7,224,000 | B2 | 5/2007 | Anaegola et al. |
| 7,260,939 | B2 | 8/2007 | Weaver, Jr. |
| 7,305,839 | B2 | 12/2007 | Weaver, Jr. |
| 7,327,078 | B2 | 2/2008 | Setlur et al. |
| 7,431,479 | B2 | 10/2008 | Weaver, Jr. et al. |
| 7,439,741 | B2 | 10/2008 | Arik et al. |
| 7,479,662 | B2 | 1/2009 | Soules et al. |
| 7,482,634 | B2 | 1/2009 | Wojnarowski et al. |
| 7,489,132 | B2 | 2/2009 | Arik et al. |
| 7,498,507 | B2 | 3/2009 | Weaver, Jr. et al. |
| 7,543,961 | B2 | 6/2009 | Arik et al. |
| 7,556,406 | B2 | 7/2009 | Petroski et al. |
| 7,572,973 | B2 | 8/2009 | Weaver, Jr. et al. |
| 7,635,203 | B2 | 12/2009 | Weaver, Jr. |
| 7,635,869 | B2 | 12/2009 | Kolodin et al. |
| 7,683,391 | B2 | 3/2010 | Wojnarowski et al. |
| 7,688,583 | B1 | 3/2010 | Arik et al. |
| 7,717,591 | B2 | 5/2010 | Weaver, Jr. |
| 7,740,514 | B2 | 6/2010 | Setlur et al. |
| 7,805,950 | B2 | 10/2010 | Weaver, Jr. |
| 7,812,604 | B2 | 10/2010 | Icoz et al. |
| 7,878,232 | B2 | 2/2011 | Arik et al. |
| 7,884,382 | B2 | 2/2011 | Setlur et al. |
| 7,928,561 | B2 | 4/2011 | Weaver et al. |
| 7,969,734 | B2 | 6/2011 | Arik et al. |
| 7,990,705 | B2 | 8/2011 | Bult et al. |
| 2004/0107718 | A1 | 6/2004 | Bowman et al. |
| 2004/0188696 | A1 | 9/2004 | Chen et al. |
| 2004/0190305 | A1 | 9/2004 | Arik et al. |
| 2005/0061803 | A1 | 3/2005 | Sivasubramaniam et al. |
| 2006/0068611 | A1 | 3/2006 | Weaver, Jr. et al. |
| 2006/0196638 | A1 | 9/2006 | Glezer et al. |
| 2007/0053168 | A1 | 3/2007 | Sayir et al. |
| 2007/0096118 | A1 | 5/2007 | Mahalingam et al. |
| 2007/0114557 | A1 | 5/2007 | Shelton et al. |
| 2008/0017237 | A1 | 1/2008 | Bray et al. |
| 2008/0035947 | A1 | 2/2008 | Weaver Jr. et al. |
| 2008/0041574 | A1 | 2/2008 | Arik et al. |
| 2008/0137289 | A1 | 6/2008 | Arik et al. |
| 2008/0145960 | A1 | 6/2008 | Kolodin et al. |
| 2008/0310110 | A1 | 12/2008 | Arik et al. |
| 2009/0001372 | A1 | 1/2009 | Arik et al. |
| 2009/0067034 | A1 | 3/2009 | Woo et al. |
| 2009/0120615 | A1 | 5/2009 | Icoz et al. |
| 2009/0166653 | A1 | 7/2009 | Weaver, Jr. et al. |
| 2010/0018843 | A1 | 1/2010 | Aimi et al. |
| 2010/0033071 | A1 | 2/2010 | Heffington et al. |
| 2010/0051242 | A1 | 3/2010 | Arik et al. |
| 2010/0051721 | A1 | 3/2010 | Arik et al. |
| 2010/0053891 | A1 | 3/2010 | Arik et al. |
| 2010/0054973 | A1 | 3/2010 | Arik et al. |
| 2010/0055885 | A1 | 3/2010 | Robinson et al. |
| 2010/0067191 | A1 | 3/2010 | Arik et al. |
| 2010/0079943 | A1 | 4/2010 | Arik et al. |
| 2010/0110630 | A1 | 5/2010 | Arik et al. |
| 2010/0258270 | A1 | 10/2010 | Arik et al. |
| 2010/0271775 | A1 | 10/2010 | Bult et al. |
| 2010/0284147 | A1 | 11/2010 | Arik et al. |
| 2010/0294461 | A1 | 11/2010 | Weaver, Jr. et al. |
| 2010/0294467 | A1 | 11/2010 | Varanasi et al. |
| 2010/0294475 | A1 | 11/2010 | Rush et al. |
| 2010/0328896 | A1 | 12/2010 | Shaddock et al. |
| 2011/0080096 | A1 | 4/2011 | Dudik et al. |
| 2011/0114287 | A1 | 5/2011 | Arik et al. |
| 2011/0139429 | A1 | 6/2011 | Salapakkam et al. |
| 2011/0162823 | A1 | 7/2011 | Sharma et al. |
| 2011/0170289 | A1 | 7/2011 | Allen et al. |
| 2011/0174462 | A1 | 7/2011 | Arik et al. |

THERMAL MANAGEMENT SYSTEMS FOR SOLID STATE LIGHTING AND OTHER ELECTRONIC SYSTEMS

CROSS-REFERENCE TO OTHER APPLICATIONS

This application claims priority of U.S. Provisional Patent Application No. 61/376,866, entitled "Thermal Management Systems for Solid State Lighting and Other Electronic Systems," filed Aug. 25, 2010, which is herein incorporated in its entirety by reference.

BACKGROUND OF THE INVENTION

The present invention relates to the illumination arts, lighting arts, solid state lighting arts, electronics arts, thermal management arts, and related arts.

Solid state lighting presents substantial thermal management issues due to the heat sensitivity and low optimal operating temperature of many solid state lighting devices, combined with low radiative and convective cooling efficiency due to the low optimal operating temperature. For example, light emitting diode (LED) devices typically have an optimal operating temperature of about 100° C. or lower, at which temperatures radiative and convective heat transfer away from the LED devices is inefficient.

Passive cooling solutions relying upon a large heat sink in thermal communication with the solid state lighting devices is of limited effectiveness. Active cooling can be more effective. For example, synthetic jets have been employed for cooling in solid state lighting. See, e.g., Arik et al., U.S. Pub. No. 2004/0190305 A1, which is herein incorporated in its entirety by reference; Bohler et al., Int'l. Appl. No. WO 2004/100213 A2, which is herein incorporated in its entirety by reference. Synthetic jets have also been employed in other cooling applications such as cooling of electronic modules. However, synthetic jets or other active cooling (e.g., fan based cooling, see e.g. Cao, U.S. Pat. No. 6,465,961) have substantial disadvantages in solid state lighting applications. The active cooling system occupies valuable space, which is especially problematic in compact lighting units and/or self contained lighting units such as retrofit lamps or light bulbs in which the electronics for driving the solid state lighting devices off of wall voltage (e.g., 110V a.c. or 220V a.c.) are integrated into the lighting unit. Positioning of the active cooling sub system in a way that is sufficiently proximate to the solid state lighting devices in order to provide cooling while not blocking the optical path is also problematic.

BRIEF DESCRIPTION OF THE INVENTION

In a first embodiment, an apparatus includes at least one electronic component. The apparatus also includes an enclosure enclosing the at least one electronic component. The enclosure includes at least one wall defined by a membrane. The apparatus further includes an electromechanical transducer configured to generate a pulsating mechanical deformation of the membrane. The apparatus also includes one or more openings in the enclosure for facilitating volume displacement of air from within the enclosure. The volume displacement of air is provided by the pulsating mechanical deformation of the membrane.

In a second embodiment, a piezoelectric actuated assembly includes a first piezoelectric actuator that is fixed at a first end of the first piezoelectric actuator. The piezoelectric actuated assembly also includes a second piezoelectric actuator that is fixed at a first end of the second piezoelectric actuator. The piezoelectric actuated assembly further includes a compliant sheet having a first end that is rigidly attached to a second end of the first piezoelectric actuator, and a second end that is rigidly attached to a second end of the second piezoelectric actuator. Application of alternating current to the first and second piezoelectric actuators generates a pulsating mechanical deformation of the compliant sheet.

In a third embodiment, an apparatus includes at least one electronic component. The apparatus also includes an enclosure enclosing the at least one electronic component. The enclosure includes at least one wall defined by a membrane. The apparatus further includes a piezoelectric actuator that is fixed at a first end and rigidly attached to the membrane at a second end. Application of alternating current to the piezoelectric actuator generates a pulsating mechanical deformation of the membrane.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
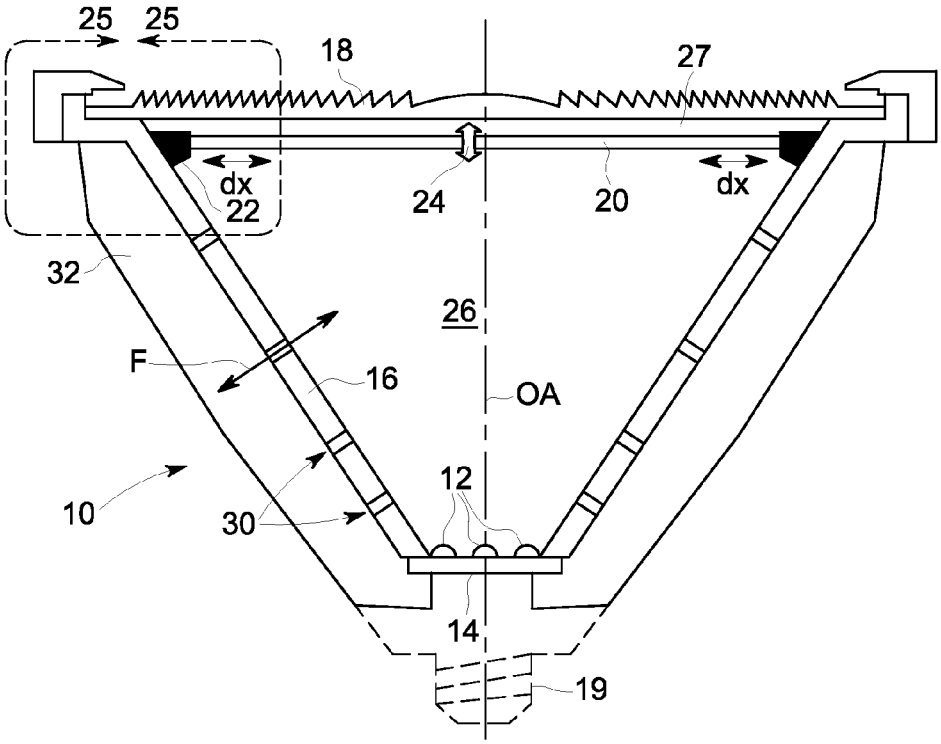
FIG. 1 is a sectional side view of an embodiment of a directional lamp having a plurality of light emitting diode (LED) devices on a circuit board, a collecting reflector, a Fresnel lens, an optical membrane, and one or more transducers for generating a reciprocating displacement of the optical membrane.

With reference to FIG. 1, a sectional side view of a directional lamp 10 having rotational symmetry about an optical axis OA is shown, which includes a plurality of light emitting diode (LED) devices 12 on a circuit board 14, a collecting reflector 16 which in the illustrative embodiment is conical (although other shapes are contemplated, such as parabolic or compound parabolic), and a Fresnel lens 18. More generally, the LED devices 12 can be replaced by one or more other solid state lighting devices, such as one or more organic LED (OLED) devices, one or more electroluminescent (EL) devices, or so forth. In a typical configuration, the light engine 12, 14 is arranged at about the focal length of the Fresnel lens 18 so that the lens 18 images the light engine at infinity so as to form a directional beam. The collecting reflector 16 collects large angle light, and may also optionally provide collimation to assist in forming the beam. In some embodiments, the lens 18 is omitted and the reflector 16 alone is relied upon to form the directional light beam. In another alternative, the lens may be located elsewhere than where shown in FIG. 1, such as proximate to the LED devices 12. Not shown are additional components such as electronics, which may be disposed in a module "behind" the light engine 12, 14, for example in a connector portion 19 (shown in phantom in FIG. 1, and also including an optional "Edison-type" base for connection of the lamp 10 with a standard socket).

An optical membrane 20 is disposed in the beam path. As illustrated, in certain embodiments, the optical membrane 20 is disposed inside the Fresnel lens 18 (e.g., on the same side of the Fresnel lens 18 as the LED devices 12). However, in other embodiments, the optical membrane 20 may be disposed outside of the Fresnel lens 18 (e.g., on an opposite side of the Fresnel lens 18 from the LED devices 12). The optical membrane 20 is optically transparent or translucent. In some embodiments, the optical membrane is a transparent or translucent optical window. In some embodiments, the optical membrane 20 acts optically as a light diffuser by including diffusing particles or making the membrane 20 of a light scattering material, or by providing the membrane 20 with a roughened or otherwise light scattering or light refracting surface, or so forth.

It is also additionally or alternatively contemplated for the optical membrane 20 to be a wavelength converting element including, for example, at least one phosphor compound, or a quantum dot wavelength converter, or so forth. In some such embodiments, the LED devices 12 may generate white, blue, violet, or ultraviolet light and the phosphor of the optical membrane 20 is selected such that the output light (which may be entirely wavelength converted by the phosphor or may be a mixture of direct and wavelength converted light) is white light. Still further, the optical membrane 20 may additionally or alternatively provide other optical functionality, such as providing an anti reflection coating, wavelength selective filtering to remove ultraviolet light or other light that may be undesirable in the directional light beam, or so forth.

The optical membrane 20 also serves a secondary purpose (besides being an optical window or other optical element)—the optical membrane 20 serves as an active cooling element.

Toward this end, at least one electromechanical transducer 22 is configured to generate a force or small reciprocating linear displacement dx causing a pulsating mechanical deformation of the optical membrane 20. The electromechanical transducer(s) can comprise a plurality of transducers at the periphery of the optical membrane 20 and spaced at angular intervals around the optical axis OA, or a single annular transducer may be disposed at the membrane periphery. In the illustrative embodiment, the transducer 22 generates the reciprocating linear displacement dx in the plane of the membrane 20 with all displacements being in phase (e.g., all displacing "inward" at the same instant) so as to cause the optical membrane 20 to undergo an "up/down" motion indicated by an up/down arrow 24. In some embodiments, the pulsating mechanical deformation of the membrane 20 takes the form of excitation of a resonant standing wave drum membrane mode in the optical membrane 20. Additionally or alternatively, the pulsating mechanical deformation may include various patterns, and may or may not be resonant. Still further, it is contemplated for the transducer(s) 22 to generate displacements in a direction transverse to the membrane, or in a direction intermediate between in plane and transverse respective to the membrane, or to produce some other complex motion leading to a pulsating mechanical deformation of the membrane. The term "pulsating" is intended to broadly encompass periodic motion (for example, sinusoidal motion, oscillating motion, or a periodic pulse train), quasi periodic motion (for example, a pulse train in which the pulse frequency varies with time), non periodic motion such as stochastic motion, or so forth.

The pulsating mechanical deformation produces a volume displacement of air with a frequency or other time variation corresponding to the pulsating. This provides air movement that actively cools the at least one solid state lighting device (e.g., the illustrative LED devices 12). The active cooling of the solid state lighting device may operate directly on the solid state lighting device, or indirectly by actively cooling a heat sink in thermal communication with the solid state lighting device. In some embodiments, the optical membrane 20 forms at least one wall of an enclosure. The term "enclosure" here means a set of walls, surfaces, elements, or so forth which encloses a volume, or a solid having a cavity enclosing a volume, or so forth, in which the enclosed volume is substantially airtight except for one or more optional openings defining synthetic jets or other airflow paths as disclosed herein. The term "enclosure" as used here is not limited to an external housing or outermost enclosure. In the illustrative example, the optical membrane 20 and the collecting reflector 16 cooperatively form an enclosure enclosing a volume 26, which is typically filled with air (although filling with another fluid is also contemplated). The volume displacement of air provided by the pulsating mechanical deformation of the optical membrane 20 produces movement of the fluid in the constricted space of the volume 26. In the illustrative example of FIG. 1, it will be noted that a second, smaller air space 27 is located between the Fresnel lens 18 and the optical membrane 20. This smaller air space is optionally vented to the exterior, for example via holes in or at the periphery of the lens 18, so that the air space 27 does not create viscous or flow resistance to the pulsating mechanical deformation of the membrane 20.

In some embodiments, the enclosure defined in part by the membrane 20 is further provided with one or more openings 30 which allow air flow (diagrammatically indicated for one opening in FIG. 1 by a double arrow F, but understood to occur at all the openings 30) into or out of the enclosed volume 26. In some such embodiments, the openings 30 and the membrane 20 cooperate to define synthetic jets at the openings 30. The volume displacement of air provided by the pulsating mechanical deformation of the optical membrane 20 and a size of the at least one opening 30 are selected such that the volume displacement of air provided by the pulsating mechanical deformation of the optical membrane 20 produces at least one synthetic jet. To accomplish this, the volume displacement of air should be large enough, and the opening or openings 30 small enough, so that the volume displacement of air accelerates air flow into or out of the opening or openings 30, thus forming one or more synthetic jets. In general, a larger volume displacement of air increases the air acceleration of the synthetic jet or jets, and similarly a smaller total area of the opening or openings 30 increases the air acceleration of the synthetic jet or jets. The synthetic jet or jets are arranged to enhance air cooling of the at least one solid state lighting device (e.g., the illustrative LED devices 12).

In FIG. 1, the synthetic jets enhance air cooling of the LED devices 12 indirectly, by arranging the openings 30 to produce air flow or air turbulence proximate to heat fins 32 spaced apart around the collecting reflector 16. Without loss of generality, there are N heat fins spaced apart around the collecting reflector 16 at angular intervals of 360°/N. Note that in this case the rotational symmetry of the directional lamp 10 is an N fold rotational symmetry. The heat fins 32 are in thermal communication with the LED devices 12 via the circuit board 14 (which optionally includes a metal core in thermal communication with the heat sinking fins 32). The acceleration of air proximate to the heat fins produce air flow and turbulence that promotes heat transfer from the heat fins to the surrounding ambient by air convection. The advantage of active cooling is seen in the heat removal equation $Q=hA\Delta T$, where A denotes the surface area over which the thermal transfer to ambient occurs and $\Delta T$ denotes the difference between the temperature of that surface and the ambient temperature. In general, $\Delta T$ is substantially fixed by the operating temperature of the solid state lighting device and the ambient temperature. Thus, $\Delta T$ is usually not available as a design parameter. The surface area A can be increased to increase the rate of heat removal, as is conventionally done by adding fins or other surface area enhancing heat dissipating structures to a heat sink. The parameter h, known as the heat transfer coefficient, is controlled by convective air flow in passive cooling, and is difficult or impossible to adjust in the passive configuration. However, by employing active cooling such as a synthetic jet or jets, the air flow can be substantially increased, sometimes by orders of magnitude, and the heat transfer coefficient h and consequently the heat transfer rate Q is correspondingly increased.

Figure 2:
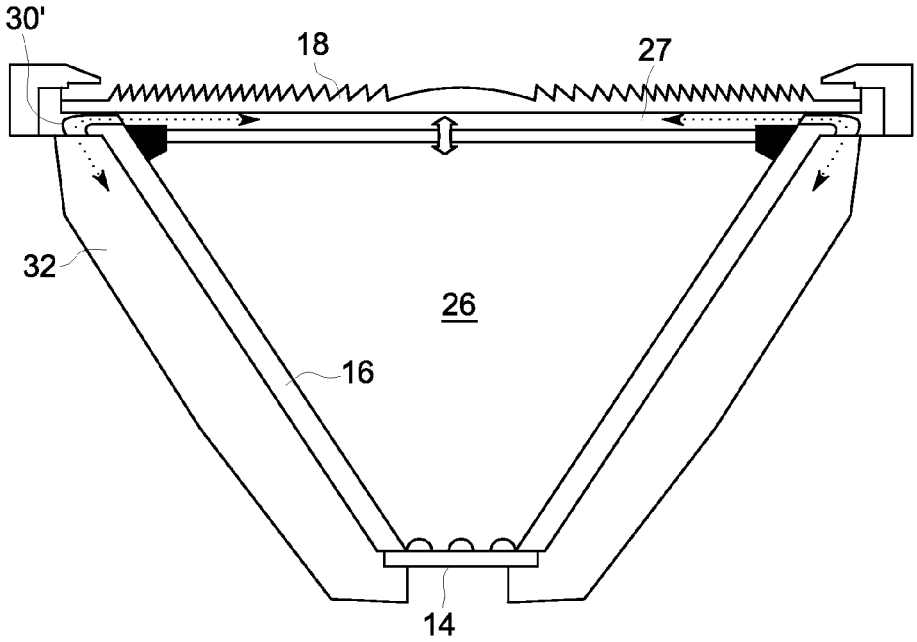
FIG. 2 is a sectional side view of an embodiment of the directional lamp of FIG. 1 having openings for enabling synthetic jets from an interior air volume between the Fresnel lens and the optical membrane.
Figure 3:
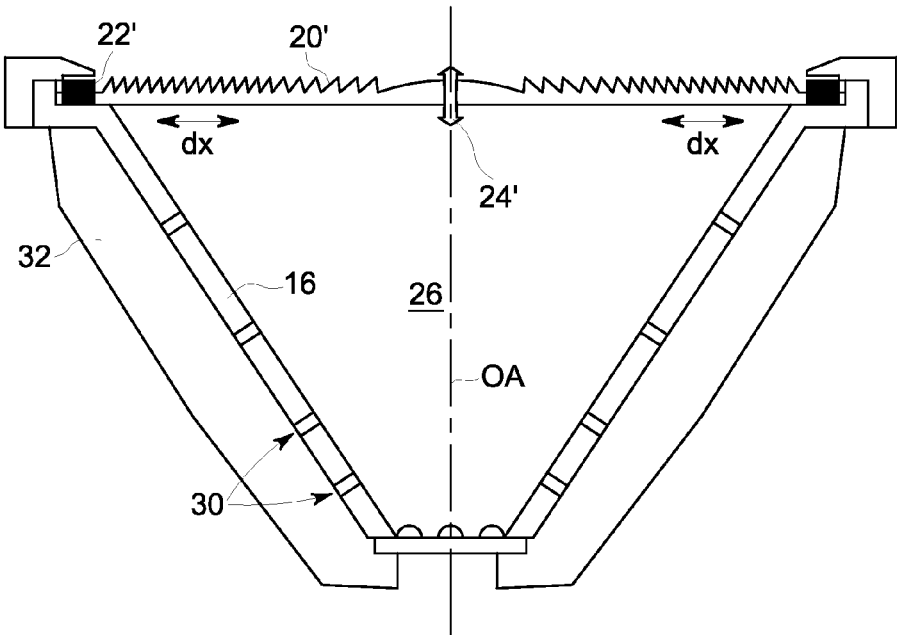
FIG. 3 is a sectional side view of an embodiment of the directional lamp of FIG. 1 wherein the optical membrane comprises the Fresnel lens.

FIG. 2 differs from FIG. 1 in that the openings 30 of FIG. 1 are replaced by openings 30' placing the smaller air volume 27 enclosed between the lens 18 and the membrane 20 into fluid communication with the exterior. The openings 30' are curved so that the synthetic jets are directed downward over the heat sinking fins 32. FIG. 3 differs from FIG. 1 in that instead of having the optical membrane 20 and the separate lens 18, a lens 20' is the optical membrane. A modified electromechanical transducer 22' operates on the lens/optical membrane 20' to produce the reciprocating linear displacement dx, this time of the combined lens/optical membrane 20' so as to drive a pulsating mechanical deformation of the lens/optical membrane 20' as diagrammatically represented by an up/down arrow 24'. In each of FIGS. 1-3, the optical membrane 20, 20' is optically transparent or translucent. However, the optical membrane can have other optical functionality.

Figure 4:
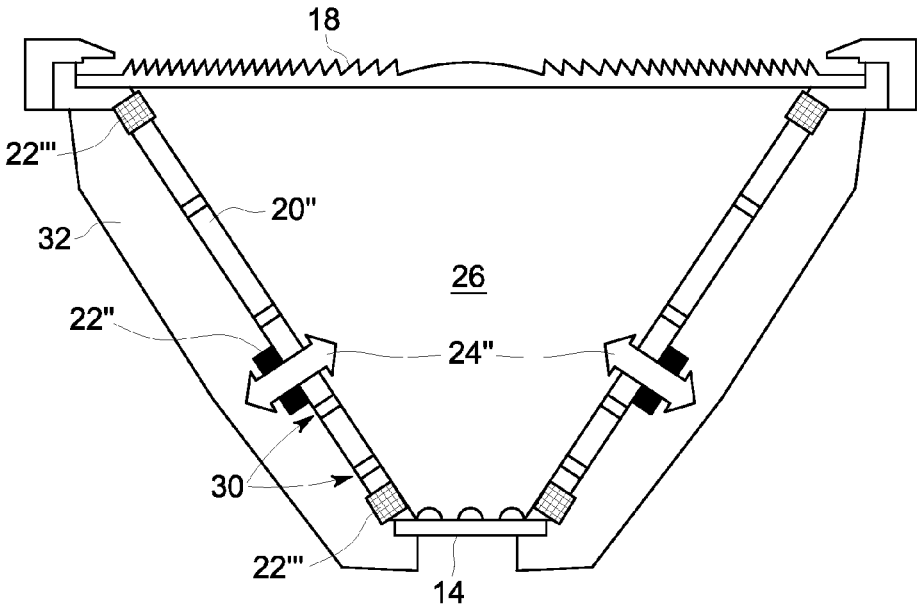
FIG. 4 is a sectional side view of an embodiment of the directional lamp of FIG. 1 having one or more transducers for generating a reciprocating displacement of the collecting reflector.

With reference to FIG. 4, a variant embodiment is shown in which an optical membrane 20" is optically reflective and takes the form of the collecting reflector. A modified electromechanical transducer 22" operates on the optical membrane/collecting reflector 20" to generate a generally inward/outward pulsating mechanical deformation of the optical membrane/collecting reflector 20" as diagrammatically represented by the double arrows 24". The embodiment of FIG. 4 employs the openings 30 in the optical membrane/collecting reflector 20" to provide the synthetic jets. In the embodiment of FIG. 4, the conventional Fresnel lens 18 (which does not act as a membrane for cooling) is used. The illustrative transducer(s) 22" produce reciprocating force in the direction normal to the surface of the membrane/reflector 20". In an alternative configuration, transducers 22'" at opposite ends of the membrane/reflector 20" produce reciprocating force in the plane of the reflector surface, so as to produce the pulsating mechanical deformation 24" as a "buckling" of the membrane/reflector 22".

Furthermore, in other embodiments, the optical membrane 20" may be optically transmissive or translucent, and may be spaced apart from (and, in certain embodiments, generally parallel to) the reflector 16 of FIGS. 1-3, thereby providing a gap between the optical membrane 20" and the reflector 16. In such an embodiment, the optical membrane 20" may pulsate in the same manner as the optical membrane 20" illustrated in FIG. 4. However, the air within the gap between the optical membrane 20" and the reflector 16 will be forced out through openings 30 in the reflector 16. Furthermore, in certain embodiments, both the optical membrane 20" and the reflector 16 may include openings 30, thereby providing two levels of air volume displacement from within the volume 26.

The pulsating mechanical deformation 24, 24', 24" of the optical membrane 20, 20', 20" is intended to provide cooling. It is generally undesirable for this pulsating to produce audible sound. Accordingly, in some embodiments, frequency components of the pulsating mechanical deformation at frequencies higher than 1500 Hz comprise no more than 10% of the total amplitude of the pulsating mechanical deformation, and in some embodiments no more than 5% of the total amplitude of the pulsating mechanical deformation, and in some embodiments no more than 2% of the total amplitude of the pulsating mechanical deformation. More generally, it is advantageous to have the pulsating mechanical deformation at a frequency or frequency range that is below the audible range. In some embodiments, the electromechanical transducer 22, 22', 22" is configured to generate the pulsating mechanical deformation of the optical membrane at a dominant frequency (i.e., the frequency component of excitation with the highest amplitude) of less than 100 Hz, and more preferably at a dominant frequency of 60 Hz or lower. In some embodiments, the electromechanical transducer 22, 22', 22" is configured to generate the pulsating mechanical deformation of the optical membrane at a dominant frequency of 30 Hz or lower. In some embodiments, the electromechanical transducer 22, 22', 22" is configured to generate the pulsating mechanical deformation of the optical membrane at a dominant frequency of 20 Hz or lower.

On the other hand, in certain embodiments, if the pulsating mechanical deformation is too slow, it may produce a visually perceptible light variation. For example, in the embodiment of FIG. 3, if the pulsating mechanical deformation is too slow, the movement of the Fresnel lens 20' may produce an optically perceptible variation. Since the human eye typically cannot perceive motion faster than about 50 Hz, or at most about 100 Hz, in these embodiments motion in a range of 50 Hz or higher (e.g., 60 Hz or 100 Hz) may be preferable to avoid visually perceptible illumination variation. More generally, it is advantageous in these embodiments to have the pulsating mechanical deformation at a frequency or frequency range that is above the range of visual perception. Ideally, the pulsating mechanical deformation should be at a frequency or frequency range that is below the audible range and above the range of visual perception. However, in practice, there may be no such range since the lower end of the audible frequency range may overlap the upper end of the frequency range of visual perception. In such cases, a tradeoff is suitably made, optionally in combination with sound damping features and/or measures taken to suppress the noise and/or visual impact of the pulsating mechanical deformation. For example, visual perception of the pulsating mechanical deformation may be reduced by judicious selection of the orientation of the motion respective to the optical path.

Advantageously, the optical membrane 20, 20', 20" can be made large, e.g. on the order of a few centimeters or larger for a directional lamp sized to comport with a typical MR or PAR lamp standard. The large size enables effective active cooling with operation at lower frequency, and the natural resonant frequency of the larger membrane is typically smaller. Thus, operation of the large optical membrane 20, 20', 20" can be at substantially lower frequency than synthetic jets used for lamp cooling which are disposed with electronics "behind" the circuit board, because the size constraints in such cases limit the membrane size in such synthetic jets. In general, the natural resonance frequency of the membrane is controlled by design parameters such as membrane area, membrane thickness, and membrane elastic properties (e.g., elastic modulus).

The material of the optical membrane 20, 20', 20" should provide sufficient transparency, translucency, reflectivity, or other requisite optical properties for the intended optical functionality. Additionally, the material of the optical membrane 20, 20', 20" should provide suitable mechanical properties to accommodate the pulsating mechanical deformation. These mechanical properties include stiffness, flexibility, sturdiness, and so forth. Some suitable optical membrane materials include polymers, aluminum or other metal foils or films, thin glass disks or the like, ceramics, nano-fiber composites, or so forth.

The electromechanical transducer or transducers 22, 22', 22" can employ any mechanism suitable for imparting the pulsating mechanical deformation to the optical membrane 20, 20', 20". For example, in some illustrative embodiments, the electromechanical transducer or transducers 22, 22', 22" comprises a piezoelectric transducer, while in some other illustrative embodiments the electromechanical transducer or transducers 22, 22', 22" comprises an electromagnet and a suitable alternating drive current or voltage, while in some other illustrative embodiments the electromechanical tranducer or transducers 22, 22', 22" employ a microelectromechanical system (MEMS) technology. In the illustrative embodiments the optical membrane 20, 20', 20" and the electromechanical transducer 22, 22', 22" are different elements, which advantageously allows selection of the membrane material to meet the desired optical and mechanical deformation characteristics without regard to piezoelectric or other drive-related characteristics. However, it is contemplated to employ a membrane with integral drive characteristics where a material has both suitable optical and mechanical deformation characteristics and suitable drive characteristics. For example, quartz is a transparent material which also exhibits some piezoelectric behavior, and is contemplated for use as an integral optical membrane/electromechanical transducer. In the illustrative embodiments, the electromechanical transducer 22, 22', 22" is proximate to the driven optical membrane 20, 20', 20". Such proximity enables direct, and hence efficient, transfer of the mechanical force to the membrane. However, it is also contemplated to have the electromechanical transducer spaced apart from the driven membrane with a suitable mechanical linkage to transmit the mechanical force from the transducer to the membrane.

Figure 5:
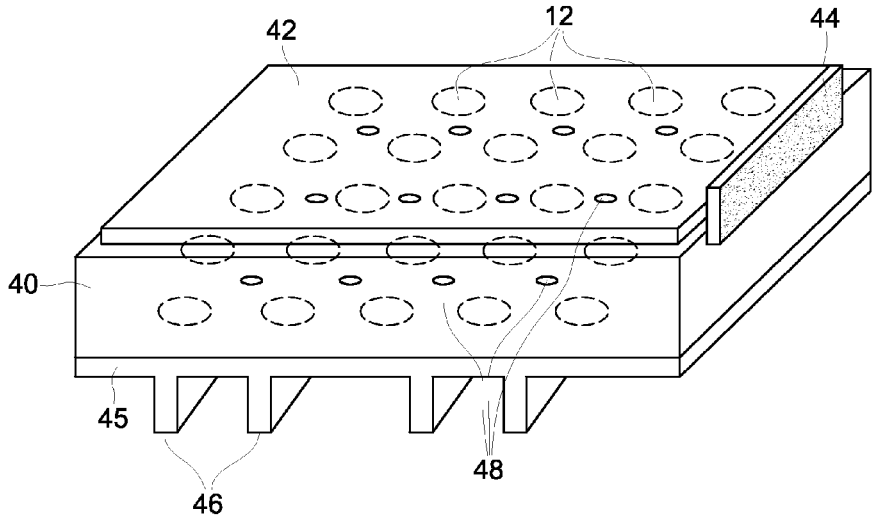
FIG. 5 is a perspective view of an embodiment of a panel lamp having LED devices disposed in a plane in a rectangular housing having a top wall as a transparent or translucent optical membrane, and one or more transducers for generating a reciprocating displacement of the optical membrane.
Figure 6:
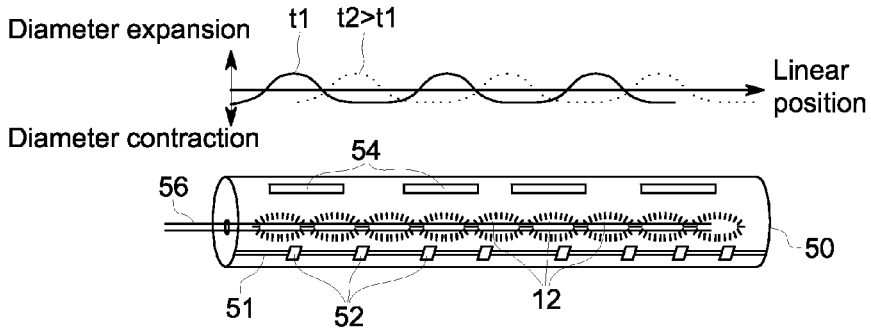
FIG. 6 is a perspective view of an embodiment of a linear lamp having a linear array of LED devices disposed in a tubular housing as a transparent or translucent optical membrane, and one or more transducers spaced along the tubular housing for generating a reciprocating displacement of the optical membrane.
Figure 7:
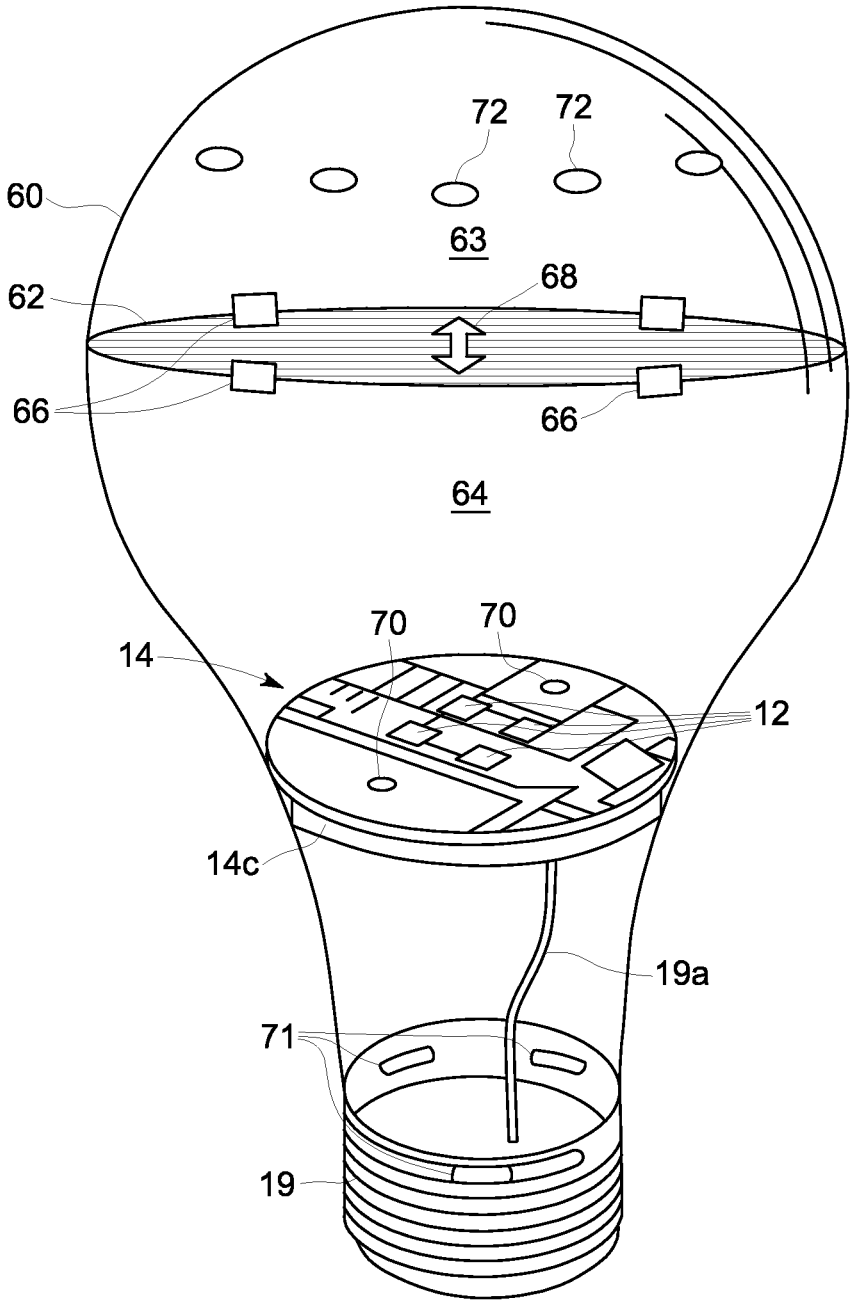
FIG. 7 is a perspective view of an embodiment of an omnidirectional lamp having LED devices on a circuit board, a transparent or translucent optical membrane horizontally spanning a bulb-shaped envelope of the omnidirectional lamp, and one or more transducers disposed on the bulb-shaped envelope of the omnidirectional lamp for generating a reciprocating displacement of the optical membrane.

The directional lamps of FIGS. 1-4 are illustrative examples. The disclosed active cooling approaches are applicable in directional lamps of other configurations. As another example (not illustrated), a directional lamp may comprise a large area circuit board supporting an array of LED devices, optionally disposed in individual reflector cups, with a Fresnel lens positioned parallel with the circuit board and closely proximate to and in front of the LED devices, with a large and optionally finned heat sink disposed behind the circuit board. In such a configuration, the Fresnel lens is suitably the optical membrane, the enclosure is suitably defined by the Fresnel lens and the circuit board, and the openings forming the synthetic jets suitably pass through the circuit board to inject synthetic jets into or across the heat sink located behind the circuit board. Moreover, the disclosed active cooling approaches are applicable to other lamp designs besides directional lamps. With reference to FIGS. 5-7, some other illustrative types of lamps employing the disclosed active cooling approaches are described.

FIG. 5 illustrates a panel lamp, including LED devices 12 (internal components shown in phantom in FIG. 5) disposed in a plane in a rectangular housing or enclosure 40 that is mostly opaque, but which has a top wall 42 (e.g., a flat panel) comprising an optical membrane that is optically transparent or translucent. An electromechanical transducer 44 running along one side of the wall/optical membrane 42 operates to generate a pulsating mechanical deformation of the optical membrane 42. A bottom wall 45 of the enclosure 40 is thermally conductive, for example comprising a copper plate, and includes heat sinking fins 46 or other heat radiating surface extensions. Openings 48 in the bottom wall 45 cooperate with the pulsating mechanical deformation of the optical membrane 42 to form synthetic jets that generate air flow across the heat sinking fins 46 to provide active cooling.

FIG. 6 illustrates a linear (e.g., elongated) lamp, including a linear array of LED devices 12 (internal component shown in phantom in FIG. 6) disposed in a tubular housing or enclosure 50 that is transparent or translucent and also serves as the optical membrane parallel with the elongated light source (i.e., the linear array of LED devices 12). The tubular enclosure 50 has airtight ends, and includes a longitudinal bellow 51 that is airtight but allows the diameter of the tubular enclosure 50 to expand or contract. Electromechanical transducers 52 are spaced apart along the tubular (e.g., elongated) housing or enclosure/membrane 50 and operate to on the bellow 51 to produce a pulsating mechanical deformation of the optical membrane 50 in the form of pulsating expansion/contraction of the tube diameter. Slots 54 provide openings that cooperate with the pulsating mechanical deformation of the optical membrane 50 to form synthetic jets that actively cool the LED devices 12. In this embodiment, the tubular enclosure is in thermal communication with the LED devices 12 (for example, by mounting the LED devices 12 on an inside surface of the tubular enclosure/optical membrane 50, optionally with sub mount, linear circuit board, LED socket/connector assembly, or other intermediary components). The LED devices 12 receive electrical power via an electrical power cable 56 passing through the tubular enclosure 50. In the illustrative embodiment, there is no separate heat sinking component, rather, the tubular enclosure/optical membrane 50 is itself thermally conductive (for example, by including dispersed thermally conductive particles in the material, or employing a suitably thermally conductive membrane material), and heat sinking is from the LED devices 12 to the tubular enclosure/optical membrane 50 to the ambient, aided by the synthetic jets formed at the slots 54 by the expansion/contraction of the diameter of the enclosing tubular membrane 50. To achieve the expansion/contraction, the transducers 52 operate synchronously (i.e. expanding and contracting in phase). In some alternative embodiments, the transducers 52 operate in a phase pattern that generates the pulsating mechanical deformation as a traveling wave of tube expansion/contraction that travels along the length of the housing/membrane 50. This is diagrammatically plotted above the linear lamp, showing the deformation as a function of linear position for two times t1 and t2, which is greater than t1.

In a contemplated variation of the embodiment of FIG. 6, the slots 54 may be omitted and openings provided at both ends of the tube/membrane 50, so that the traveling waves produce a unidirectional airflow stream through the tube. The tubular housing or enclosure 50 may have a relatively high degree of rigidity such that the linear lamp is relatively inflexible. Alternatively, the tubular housing or enclosure 50 may have a relatively high degree of flexibility such that the linear lamp is a flexible linear lighting strip. In either the panel lamp of FIG. 5 or the linear lamp of FIG. 6, the optical membrane 42, 50 optionally provides additional optical functionality such as optical diffusion, wavelength conversion (e.g., using an embedded or dispersed phosphor), microlensing, or so forth.

Figure 8:
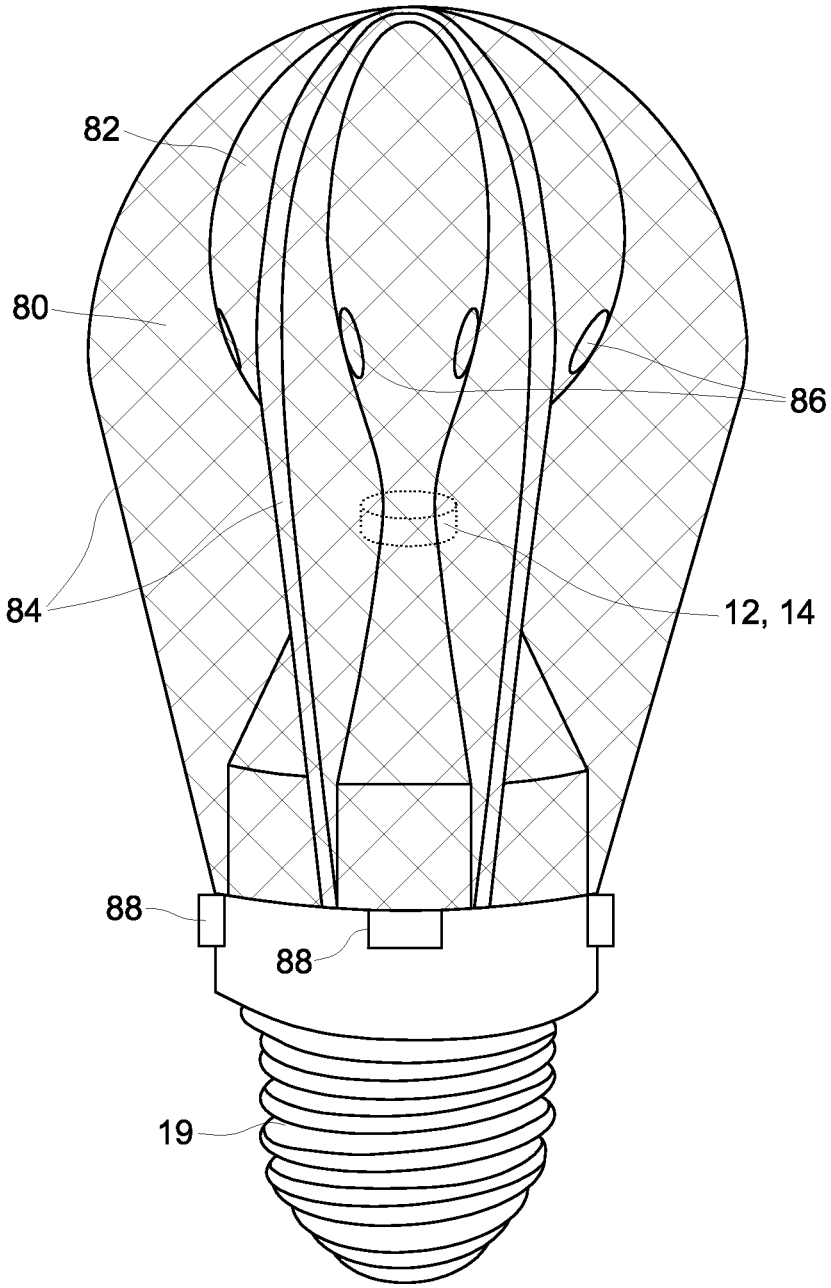
FIG. 8 is a perspective view of an embodiment of an omnidirectional lamp having a bulb-shaped outer transparent or translucent optical element as an optical membrane, a rigid bulb-shaped inner transparent or translucent optical element, a plurality of heat sinking fins disposed between the inner and outer optical elements, and a plurality of transducers for inducing mechanical deformation of the outer optical element.

FIGS. 7 and 8 illustrate omnidirectional lamp embodiments based on a light engine including LED devices 12 on a circuit board 14 (visible in FIG. 7; internal component diagrammatically indicated in phantom in FIG. 8). In the embodiment of FIG. 7, the circuit board 14 includes a metal core 14*c*, and the LED devices 12 illuminate inside a bulb shaped (e.g., spherical, spheroidal, egg shaped, and so forth) envelope 60. A transparent or translucent optical membrane 62 horizontally spans the bulb to divide between an upper volume 63 and a lower volume 64. Electromechanical transducers 66 drive the optical membrane to excite an "up/down" pulsating mechanical deformation of the optical membrane 62, indicated by up/down arrow 68. Openings 70 in the circuit board 14 and slots 71 in the Edison connector 19 provide for air flow, with air accelerating through the openings 70 providing the synthetic jets actively cooling the metal core 14*c* of the circuit board 14. Although not illustrated, it is contemplated to include grooves, slots, or other airflow pathways in the metal core 14*c* to promote air flow across a large surface of the metal core 14*c*. Such grooves, slots, or so forth, are preferably designed to balance air flow proximate to the metal core 14*c*, which is desired, against increased air flow resistance that can reduce the effectiveness of the synthetic jets. This balancing entails, for example, making the grooves, slots, or so forth, of relatively large cross sectional area so as to reduce their resistance to the air flow. Moreover, optional openings 72 in the upper portion of the bulb shaped envelope 60 ensure that the upper volume 63 does not impose resistance on the motion 68 of the optical membrane 62. As in other embodiments, the optical membrane 62 may optionally be frosted or otherwise light diffusing, and/or may include a wavelength converting phosphor, or so forth. In certain embodiments, the membrane 62 may be a transparent optical window. Furthermore, in certain embodiments, the membrane 62 may be partially reflective or reflective on portions of the surface of the membrane 62.

Although illustrated in FIG. 7 as including a single membrane 62, in other embodiments, a plurality of membranes 62 may instead be used. In certain embodiments, the multiple membranes 62 may be parallel with each other, similar to the geometry of the optical membrane 20 and the Fresnel lens 18 illustrated in FIGS. 1 and 2. In certain embodiments, some of the membranes 62 may be relatively rigid members (e.g., like the Fresnel lens 18 described above with respect to FIGS. 1-4), whereas some of the other membranes 62 may be more compliant membranes (e.g., like the optical membranes 20, 20', 20" described above with respect to FIGS. 1-4), for example, capable of experiencing deflection caused by the electromechanical transducers 66. Each of the multiple membranes 62 may be transparent, translucent, or reflective. In addition, each of the multiple membranes 62 may be planar, conical, or of some other shape.

The embodiment of FIG. 8 employs a bulb-shaped (e.g., spherical, spheroidal, egg shaped, and so forth) outer transparent or translucent optical element 80 comprising the optical membrane. The bulb-shaped transparent or translucent optical element 80 is indicated by cross hatching in FIG. 8, and may be configured to be a diffuser so that the lamp emits omnidirectional illumination over an omnidirectional illumination latitudinal range spanning at least $\theta=[0°, 120°]$, or preferably spanning at least $\theta=[0°, 135°]$ (where 0° is the "top" of the "light bulb") responsive to generation of illumination inside the bulb-shaped transparent or translucent optical element 82 by the light engine 12. Optionally, the outer bulb-shaped transparent or translucent optical element 80 may include a wavelength-converting phosphor, so that (by way of illustrative example), the LED devices may emit ultraviolet, violet, or blue light, and the phosphor of the optical membrane 82 is selected such that the output light (which may be entirely wavelength converted by the phosphor or may be a mixture of direct and wavelength converted light) is white light.

The lamp of FIG. 8 further includes an inner transparent or translucent bulb shaped (e.g., spherical, spheroidal, egg shaped, and so forth) optical element 82, which is rigid and may be configured to be a diffuser so that the lamp emits omnidirectional illumination over an omnidirectional illumination latitudinal range spanning at least $\theta=[0°, 120°]$, or preferably spanning at least $\theta=[0°, 135°]$ (where 0° is the "top" of the "light bulb") responsive to generation of illumination inside the bulb-shaped transparent or translucent optical element 80 by the light engine 12. A heat sink in thermal communication with the LED devices includes fins 84 that span between the outer optically transparent or translucent membrane 80 and the rigid inner transparent or translucent bulb shaped optical element 82. In this embodiment, the inside of the rigid inner transparent or translucent bulb shaped optical element 82 defines an inner air volume, and an outer air volume is defined between the inner optical element 82 and the outer membrane 80. Slots 86 proximate to the heat sinking fins 84 provide limited fluid communication between the inner and outer volumes. Electromechanical transducers 88 operate on the outer optically transparent or translucent membrane 80 to induce a pulsating mechanical deformation of the outer membrane 80, which cooperates with the slots 86 to form synthetic jets directing air streams over the proximate fins 84.

With continuing reference to FIGS. 7 and 8, a base of the omnidirectional lamp includes a threaded "Edison-type" connector 19 that is adapted to thread into a conventional Edison-type socket. Accordingly, the omnidirectional lamps of FIGS. 7 and 8 are suitable as a retrofit light bulb. The base optionally contains electronics for converting the 110V a.c. or other voltage input received at the Edison connector 19 into conditioned electrical power suitable for driving the LED devices 12. Alternatively, in the embodiment of FIG. 7, wires 19*a* directly connect the high voltage a.c. to the circuit board 14, which contains on board circuitry for conditioning the electrical power to drive the LED devices 12.

In the illustrative embodiment of FIG. 7, the optical membrane 62 can be located elsewhere in the bulb 60, and optionally at different orientations (e.g., vertically oriented). By placing the membrane 62 in the bulb, it can be made large, which promotes large air displacement volume at low frequency (so as to be noiseless). In the embodiment of FIG. 8, the optical membrane is the outer bulb shaped optical element 80, while the inner bulb shaped element 82 is rigid. However, this order can be reversed, or both elements can be configured as membranes contributing to the synthetic jet.

With reference to FIGS. 1-8, various lamp embodiments have been described. However, the disclosed active cooling approaches are more generally suitable for other cooling applications, such as cooling of electronic components, heat sinks, and so forth. In such cases, the use of a large area membrane (which in these non-lamp applications may optionally be optically inactive), which may be a part of the overall enclosure, enables large volume displacement of air and operation at a low resonant vibrational frequency. In some embodiments for cooling electronic components including a circuit board, the membrane may be larger than the circuit board itself.

Figure 9:
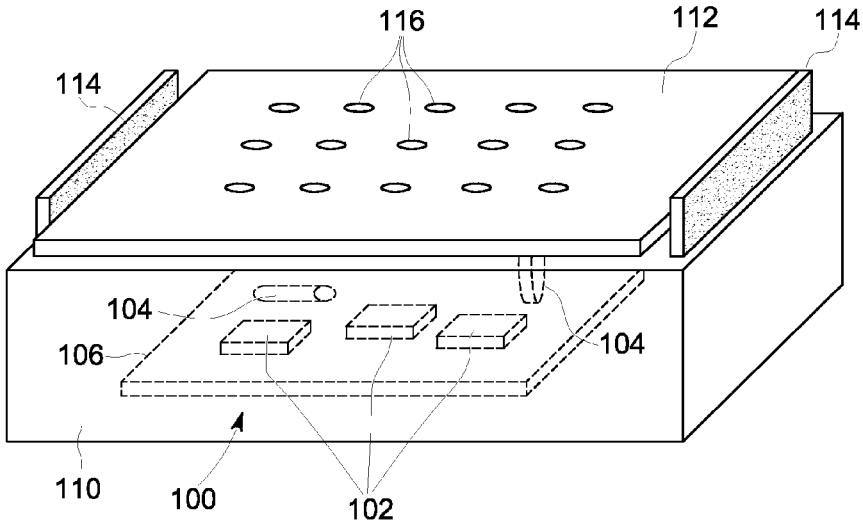
FIG. 9 is a perspective view of an embodiment of an electronic component cooling application having a plurality of electronic devices disposed on a circuit board and enclosed in an enclosure having a top wall as a transparent or translucent optical membrane, and one or more transducers for generating a reciprocating displacement of the optical membrane.

With reference to FIG. 9, an electronic component cooling application is illustrated. An electronic component 100 (internal component shown in phantom in FIG. 8) includes a plurality of electronic devices such as integrated circuit (IC) devices 102 and discrete electronic devices 104 such as resistors or capacitors, all disposed on a circuit board 106. The electronic component 100 is disposed in an enclosure 110, which includes a membrane 112 forming a top exterior wall (which, in certain embodiments, may be transparent or translucent) of the enclosure 110 facing the electronic devices 102, 104. Two electromechanical transducers 114 generate a pulsating mechanical deformation of the membrane 112. The membrane 112 is proximate to the electronic component 100 and includes openings 116, which cooperate with the pulsating mechanical deformation to provide synthetic jets directed toward and actively cooling the electronic component 100. In certain embodiments, the membrane 112 has an area larger than the electronic component 100. Although illustrated as being planar, in certain embodiments, the membrane 112 may be a non-planar membrane. Alternatively or additionally, a heat sink can be employed with the synthetic jets operating on the heat sink, as shown by way of illustrative example in FIG. 5. Said another way, in non-lamp embodiments, the configuration of FIG. 5 can be used, with the membrane 42 being optionally opaque since it does not transmit light in a non lamp application.

Figure 10:
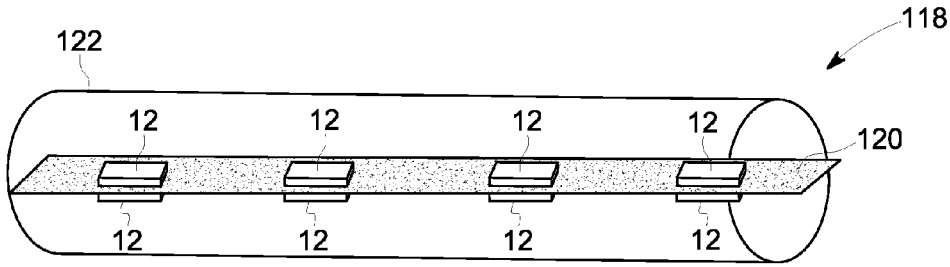
FIG. 10 is a perspective view of an embodiment of an LFL replacement tube having LED devices disposed in two linear arrays on opposite sides of a printed circuit board that extends through a transparent or translucent housing or enclosure, which acts as an optical membrane.

In certain embodiments, LED fluorescent light (LFL) replacement tubes may also include electromechanical transducers for generating airflow through the LFL replacement tubes. FIG. 10 is a perspective view of an embodiment of an LFL replacement tube 118 having LED devices 12 disposed in two linear arrays on opposite sides of a printed circuit board 120 that extends through a transparent or translucent housing or enclosure 122, which acts as an optical membrane. Having the LED devices 12 on opposite sides of the printed circuit board 120 enables light from the LED devices 12 to be emitted from the LFL replacement tube 118 for the entire 360 degrees around the LFL replacement tube 118. However, the LFL replacement tube 118 does not include a linear heat sink through the center of the LFL replacement tube 118. Rather, the illustrated LFL replacement tube 118 may be used in conjunction with other means for inducing cooling air through the LFL replacement tube 118.

Figure 11A:
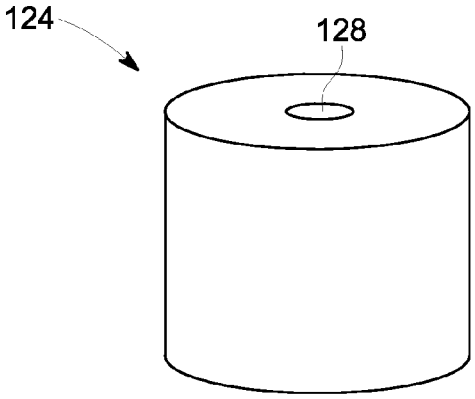
FIG. 11A is a perspective view of an embodiment of a cylindrical tube made of a flexible material and having a piezoelectric film applied to the flexible material.
Figure 11B:
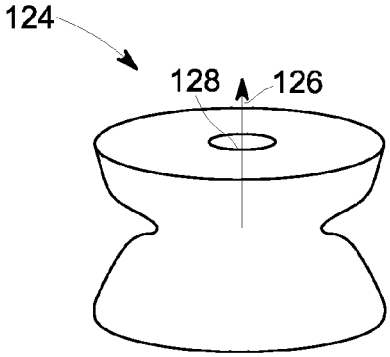
FIG. 11B is a perspective view of the cylindrical tube when the piezoelectric film causes the cylindrical tube to shorten.
Figure 11C:
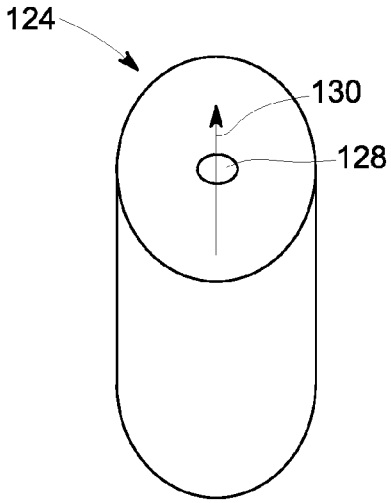
FIG. 11C is a perspective view of the cylindrical tube of FIG. 11A when the piezoelectric film causes the cylindrical tube to lengthen.

More specifically, FIG. 11A is a perspective view of an embodiment of a cylindrical tube 124 made of a flexible material and having a piezoelectric film applied to the flexible material. As such, when an electrical current is applied to the piezoelectric film, the flexible material of the cylindrical tube 124 may be caused to deform. In particular, the electrical current applied to the piezoelectric film may cause the cylindrical tube 124 to shorten or lengthen. Indeed, in certain embodiments, an alternating current may cause the cylindrical tube 124 to shorten and lengthen in an alternating manner. For example, FIG. 11B is a perspective view of the cylindrical tube 124 of FIG. 11A when the piezoelectric film causes the cylindrical tube 124 to shorten. When this happens, air may be forced out of one end of the cylindrical tube 124 due to the shortened length of the cylindrical tube 124, as illustrated by arrow 126. Conversely, FIG. 11C is a perspective view of the cylindrical tube 124 of FIG. 11A when the piezoelectric film causes the cylindrical tube 124 to lengthen. When this happens, air may be forced out of one end of the cylindrical tube 124 due to the reduction in the cross-sectional area of the inner volume 128 of the cylindrical tube 124, as illustrated by arrow 130.

Figure 12:
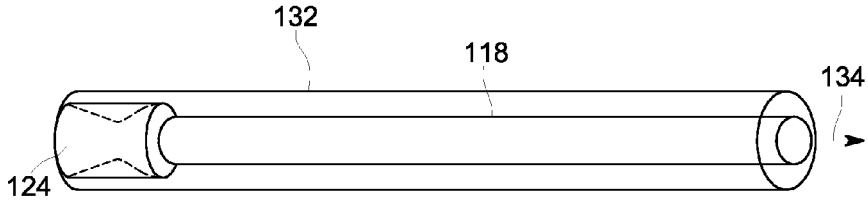
FIG. 12 is a perspective view of an embodiment of an outer transparent or translucent tube that surrounds the LFL replacement tube of FIG. 10.

Using the concepts illustrated in FIG. 11, the piezoelectric film applied to the cylindrical tube 124 may be used to generate an air flow, which may be used to cool the LFL replacement tube 118 illustrated in FIG. 10. For example, FIG. 12 is a perspective view of an embodiment of an outer transparent or translucent tube 132 that surrounds the LFL replacement tube 118 of FIG. 10. As illustrated, in certain embodiments, the cylindrical tube 124 of FIG. 11 may be disposed at one end of the outer transparent or translucent tube 132. When a current is applied to the piezoelectric film on the cylindrical tube 124, as described above with respect to FIG. 11, the cylindrical tube 124 may cause cooling air to flow through the LFL replacement tube 118, as illustrated by arrow 134, thereby providing active cooling of the LED devices 12 disposed on opposite sides of the printed circuit board 120 within the LFL replacement tube 118 of FIG. 10. In certain embodiments, more than one cylindrical tube 124 may be used along the length of the outer transparent or translucent tube 132 and the LFL replacement tube 118 to provide cooling air through the LFL replacement tube 118.

Figure 13:
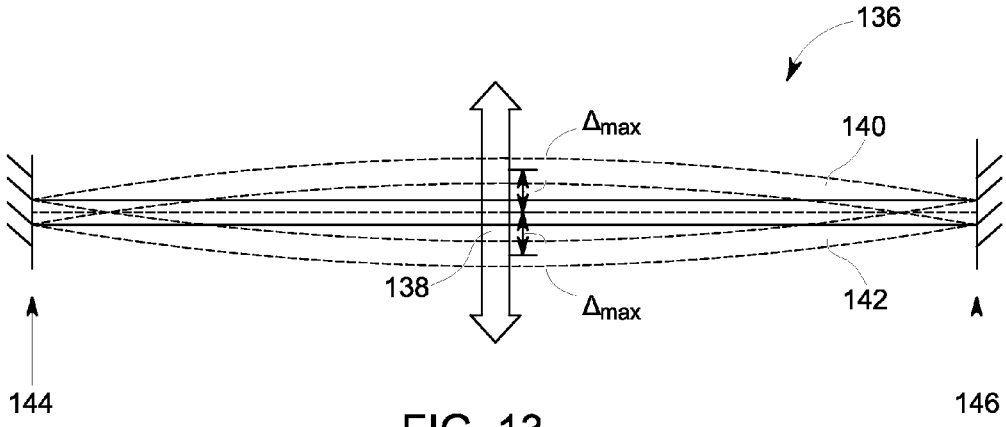
FIG. 13 is a sectional side view of an embodiment of a piezoelectric optical membrane that may be activated to experience a linear displacement.

As described above, piezoelectric transducers are one of the many types of electromechanical transducers that may be used to create the displacements of the membranes described herein, which cause volume displacements within enclosures to facilitate the flow of air across LED devices 12 and/or other electronic devices 104 for actively cooling of the LED devices 12 and/or other electronic devices 104. Indeed, in certain embodiments, the membrane that is caused to experience displacements may itself be part of the piezoelectric transducer. For example, FIG. 13 is a sectional side view of an embodiment of a piezoelectric optical membrane 136 that may be activated to experience a linear displacement. As described above, certain materials (e.g., quartz) are both transparent and exhibit piezoelectric behavior, such that they may be used as an integral optical membrane/electromechanical transducer as illustrated in FIG. 13. As such, by passing a current through the piezoelectric optical membrane 136, the piezoelectric optical membrane 136 may be linearly displaced in a direction normal to the plane of the relatively flat piezoelectric optical membrane 136, as illustrated by arrows 138. As described above, by varying the application of alternating current through the piezoelectric optical membrane 136, the piezoelectric optical membrane 136 may oscillate between opposite deformed states 140, 142, thereby causing a change in a volume of an enclosure defined at least partially by the piezoelectric optical membrane 136. In addition, because the piezoelectric optical membrane 136 is transparent, it also facilitates the dispersion of light from LED devices (e.g., the LED devices 12 described above) enclosed within the enclosure that is defined at least partially by the piezoelectric optical membrane 136. Therefore, the piezoelectric optical membrane 136 illustrated in FIG. 13 may be used as both an optical component for the LED devices, as well as enabling active cooling of the LED devices. As will be appreciated, the piezoelectric optical membrane 136 of FIG. 13 may be applied as the optical membrane 20 in several of the embodiments described above, such as the directional lamp embodiments illustrated in FIGS. 1-4.

However, two factors limit the amount of maximum deflection $\Delta_{max}$ from a centerline (e.g., in either the "up" or "down" direction) that is possible for the piezoelectric optical membrane 136. The first constraint is that the opposite ends 144, 146 of the piezoelectric optical membrane 136 illustrated in FIG. 13 are fixed (e.g., cantilevered) and, as such, the entire length of the piezoelectric optical membrane 136 is not allowed to deflect in response to the current flowing through the piezoelectric optical membrane 136. In many embodiments, opposite ends of the optical membranes described herein will all be fixed to some point of any given apparatus (e.g., the lamps and electronic components described herein). The second constraint is that, even if the piezoelectric optical membrane 136 were not fixed at its opposite ends 144, 146, the piezoelectric optical membrane 136 is only capable of experiencing a certain amount of linear deflection normal to the plane of the piezoelectric optical membrane 136 due to inherent mechanical characteristics of the piezoelectric optical membrane 136. In other words, there will always be some limitation in the amount of maximum deflection $\Delta_{max}$ that is possible in a direction normal to the plane of the piezoelectric optical membrane 136, as illustrated by arrows 138.

Figure 14:
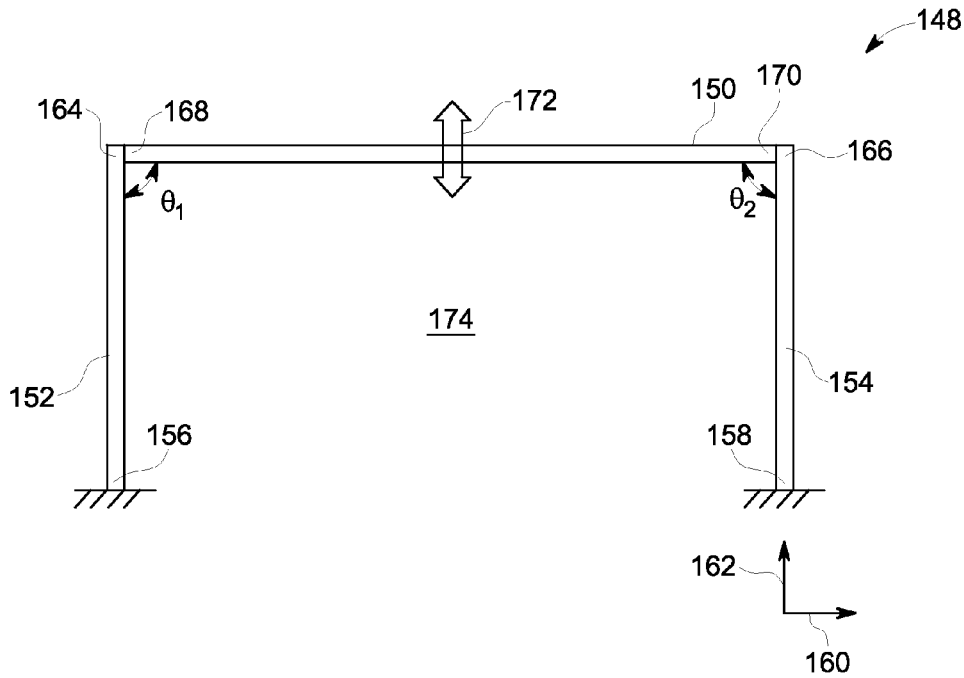
FIG. 14 is a sectional side view of an embodiment of a piezoelectric actuated assembly in a neutral position including a compliant sheet rigidly attached to opposing first and second piezoelectric actuators.

Therefore, other embodiments may include opposing piezoelectric actuators having surfaces that, in certain embodiments, may be aligned generally parallel with each other, and a compliant sheet rigidly attached (e.g., enabling substantially no movement of the compliant sheet relative to the piezoelectric actuators) to ends of the opposing piezoelectric actuators. For example, FIG. 14 is a sectional side view of an embodiment of a piezoelectric actuated assembly 148 in a neutral position including a compliant sheet 150 rigidly attached to opposing first and second piezoelectric actuators 152, 154. As illustrated in FIG. 14, respective first ends 156, 158 of the piezoelectric actuators 152, 154 are fixed (e.g., cantilevered) such that movement of the respective first ends 156, 158 in a horizontal direction 160 or a vertical direction 162 is minimal. It should be noted that the horizontal and vertical directions 160, 162 are merely included to aid discussion of the present embodiments, and is not intended to be limiting. For example, the piezoelectric actuated assembly 148 may be oriented in any manner with respect to the horizontal and vertical directions 160, 162.

As also illustrated in FIG. 14, respective second ends 164, 166 of the piezoelectric actuators 152, 154 are securely and rigidly attached to opposite first and second ends 168, 170 of the compliant sheet 150. More specifically, in certain embodiments, the second end 164 of the first piezoelectric actuator 152 is attached to the first end 168 of the compliant sheet 150 such that a generally 90° angle $\theta_1$ is formed between the first piezoelectric actuator 152 and the compliant sheet 150. Similarly, in certain embodiments, the second end 166 of the second piezoelectric actuator 154 is attached to the second end 170 of the compliant sheet 150 such that a generally 90° angle $\theta_2$ is formed between the second piezoelectric actuator 154 and the compliant sheet 150. However, it should be noted that the angles $\theta_1$ and $\theta_2$ illustrated in FIG. 14 merely represent the piezoelectric actuated assembly 148 oriented in a neutral position of one particular embodiment. In other embodiments, as described in greater detail below (e.g., with respect to FIGS. 17-21), the piezoelectric actuated assembly 148 the angles $\theta_1$ and $\theta_2$ may be different for the piezoelectric actuated assembly 148 when it is in a neutral position, such that the piezoelectric actuated assembly 148 is "preloaded" with respect to a particular neutral position.

The term "compliant" with respect to the compliant sheet 150 is intended to convey that the compliant sheet 150 is made of a relatively flexible material that is capable of experiencing deformation in a direction normal to the plane of the compliant sheet 150 when the rigid connection points formed at the first and second ends 168, 170 of the compliant sheet 150 move due to bending in the first and second piezoelectric actuators 152, 154. In addition to being made of a relatively flexible material, in certain embodiments, the compliant sheet 150 may be used as an optical membrane as described herein and, as such, the relatively flexible material from which the compliant sheet 150 is made may also be transparent or translucent, reflective, and so forth.

Figure 15:
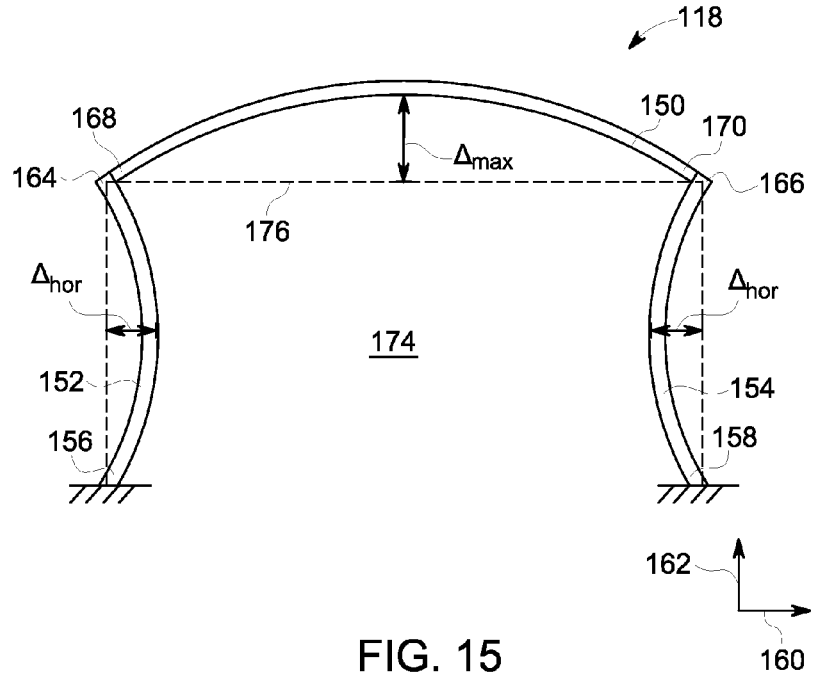
FIG. 15 is a sectional side view of the embodiment of the piezoelectric actuated assembly of FIG. 14 when the compliant sheet is in a first deformation state.
Figure 16:
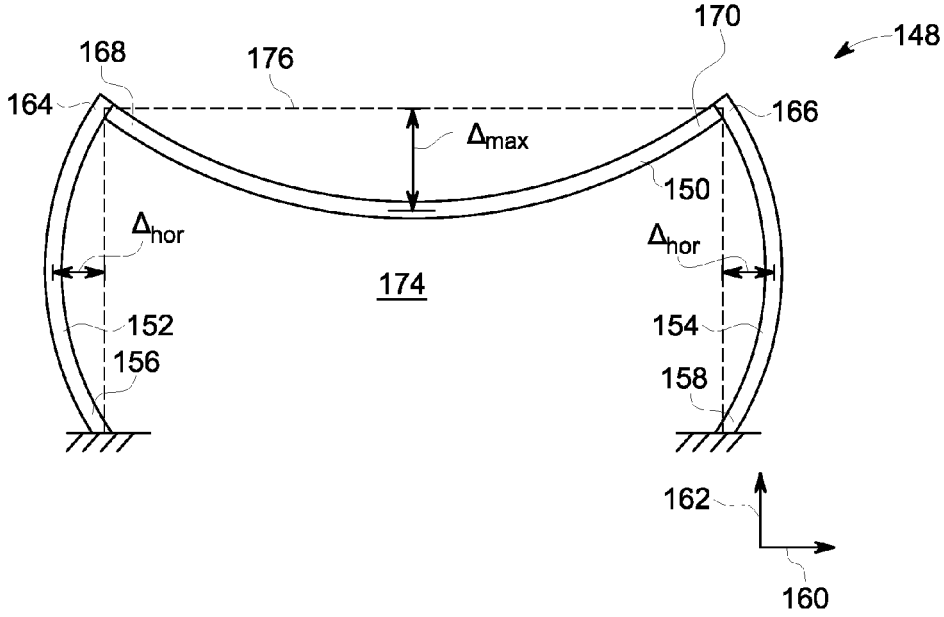
FIG. 16 is a sectional side view of the embodiment of the piezoelectric actuated assembly of FIG. 14 when the compliant sheet is in a second deformation state.

The first and second piezoelectric actuators 152, 154 are configured such that, when alternating current is applied to the first and second piezoelectric actuators 152, 154, the compliant plate 150 experiences oscillating linear displacement in the vertical direction 162, as illustrated by arrows 172. For example, FIG. 15 is a sectional side view of the embodiment of the piezoelectric actuated assembly 148 of FIG. 14 when the compliant sheet 150 is in a first deformation state, and FIG. 16 is a sectional side view of the embodiment of the piezoelectric actuated assembly 148 of FIG. 14 when the compliant sheet 150 is in a second deformation state. It should be noted that the maximum deflection $\Delta_{max}$ that is possible for the compliant sheet 150 is generally greater than the maximum deflection $\Delta_{max}$ that is possible for the piezoelectric optical membrane 136 of FIG. 13, assuming that all other characteristics are equal (e.g., length, thickness, material type, and so forth). More specifically, since the first and second piezoelectric actuators 152, 154 are made of piezoelectric materials similar to those of the piezoelectric optical membrane 136 of FIG. 13, the amount of horizontal deflections $\Delta_{hor}$ of the first and second piezoelectric actuators 152, 154 are similar to that of the piezoelectric optical membrane 136 of FIG. 13. However, the maximum deflection $\Delta_{max}$ of the compliant sheet 150 will be relatively greater than the horizontal deflections $\Delta_{hor}$ of the first and second piezoelectric actuators 152, 154 due to the rigid connections between the first and second piezoelectric actuators 152, 154 and the compliant sheet 150. As such, using the first and second piezoelectric actuators 152, 154 to oscillate the compliant sheet 150 between the first and second deformation states illustrated in FIGS. 15 and 16 may enable a greater amount of volume displacement of air from within an internal volume 174 that is at least partially defined by the first and second piezoelectric actuators 152, 154 and the compliant sheet 150.

However, as illustrated by FIGS. 15 and 16, the maximum deflection $\Delta_{max}$ of the compliant sheet 150 occurs both above and below (e.g., in the vertical direction 162) an imaginary line 176 that connects the first and second ends 168, 170 of the compliant sheet 150 (or the respective second ends 164, 166 of the first and second piezoelectric actuators 152, 154). In other words, approximately half of the total deflection of the compliant sheet 150 occurs outside of the internal volume 174 that is at least partially defined by the first and second piezoelectric actuators 152, 154 and the compliant sheet 150. In certain embodiments, due to space constraints, it may be advantageous to design the piezoelectric actuated assembly 148 such that the compliant sheet 150 is "preloaded" in a neutral position where the compliant sheet 150 is not flat having a plane that is parallel to the imaginary line 176 that connects the first and second ends 168, 170 of the compliant sheet 150 while in the neutral position.

It should be noted that while FIGS. 14-23 illustrate embodiments of the piezoelectric actuated assembly 148 having two piezoelectric actuators 152, 154 that are used to cause the compliant sheet 15 to experience oscillating linear displacements, in other embodiments, the piezoelectric actuated assembly 148 may only include one piezoelectric actuator 152, 154, with the other piezoelectric actuator 152, 154 being replaced by a wall or plate that is not actuated and, therefore, remains relatively fixed in place. In other words, only one of the ends 168, 170 of the compliant sheet 150 may be attached to a piezoelectric actuator 152, 154, while the opposite end 168, 170 of the compliant sheet 150 is attached to a wall or plate that is not actuated. As such, the deflection of the compliant sheet 150 would primarily occur at the end 168, 170 of the compliant sheet 150 that is attached to the piezoelectric actuator 152, 154, with the other end 168, 170 of the compliant sheet 150 remaining relatively fixed (e.g., cantilevered) to the opposite fixed wall or plate.

Figure 17:
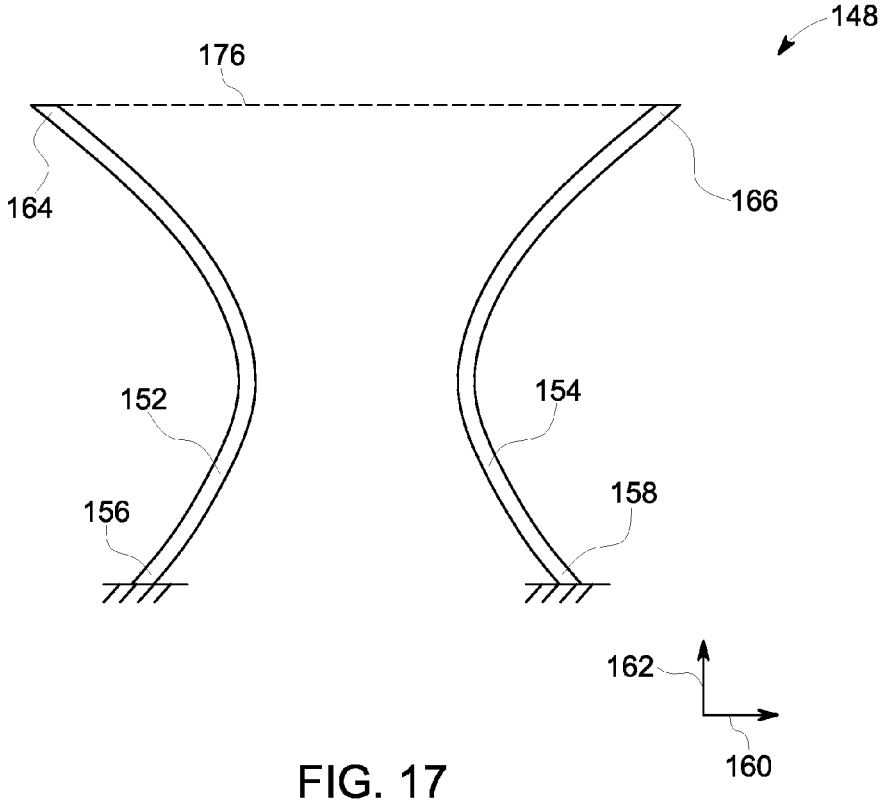
FIG. 17 is a sectional side view of an embodiment of a preloaded piezoelectric actuated assembly during construction of the preloaded piezoelectric actuated assembly.

For example, FIG. 17 is a sectional side view of an embodiment of a preloaded piezoelectric actuated assembly 148 during construction of the preloaded piezoelectric actuated assembly 148. As illustrated in FIG. 17, the first and second piezoelectric actuators 152, 154 may first be mounted such that the respective first ends 156, 158 of the piezoelectric actuators 152, 154 are fixed (e.g., cantilevered). Once the respective first ends 156, 158 of the piezoelectric actuators 152, 154 are fixed, a direct current may be applied to both of the first and second piezoelectric actuators 152, 154 such that the first and second piezoelectric actuators 152, 154 are in the first deformation state that is illustrated in FIG. 15.

Figure 18:
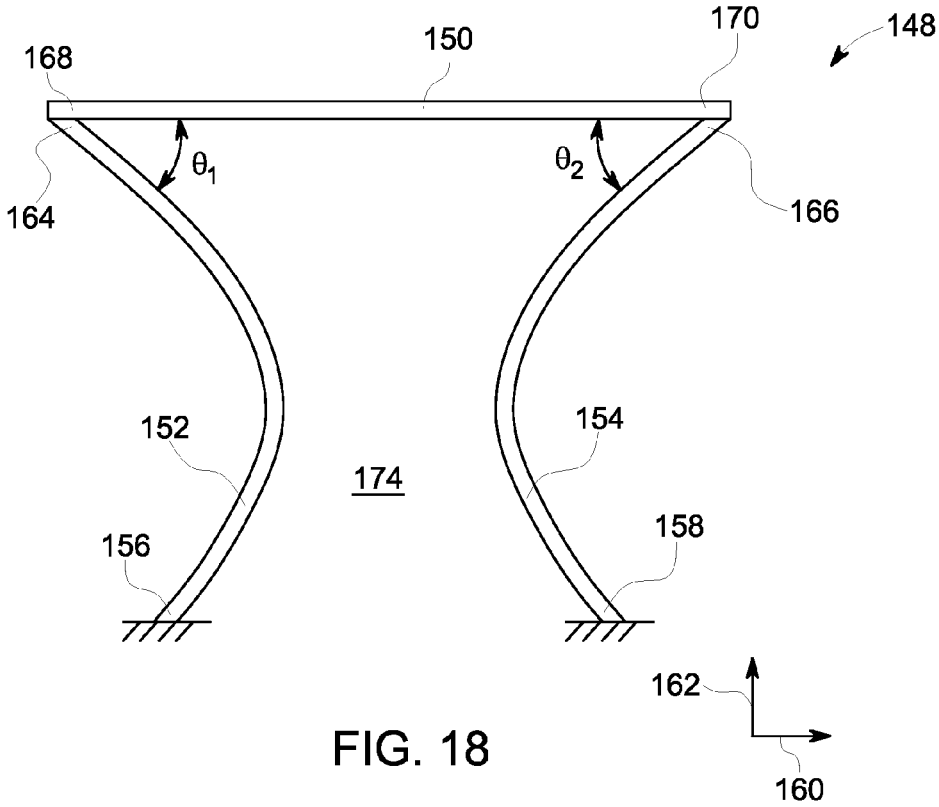
FIG. 18 is a sectional side view of the embodiment of the preloaded piezoelectric actuated assembly of FIG. 17 wherein the compliant sheet is mounted to the first and second piezoelectric actuators while a direct current is applied to the first and second piezoelectric actuators.

While the direct current remains applied, and the first and second piezoelectric actuators 152, 154 remain in the first deformation state illustrated in FIG. 17, the compliant sheet 150 may be mounted to the first and second piezoelectric actuators 152, 154 such that the compliant sheet 150 is laid flat on top of the first and second piezoelectric actuators 152, 154. In other words, the compliant sheet 150 is laid flat along the imaginary line 176 that connects the first and second ends 168, 170 of the compliant sheet 150 (or the respective second ends 164, 166 of the first and second piezoelectric actuators 152, 154) and the first and second ends 168, 170 of the compliant sheet 150 are rigidly attached to the respective second ends 164, 166 of the first and second piezoelectric actuators 152, 154 while the direct current remains applied to the first and second piezoelectric actuators 152, 154. For example, FIG. 18 is a sectional side view of the embodiment of the preloaded piezoelectric actuated assembly 148 of FIG. 17 wherein the compliant sheet 150 is mounted to the first and second piezoelectric actuators 152, 154 while a direct current is applied to the first and second piezoelectric actuators 152, 154. As such, the compliant sheet 150 is in a state of minimum stress when the direct current is applied to the first and second piezoelectric actuators 152, 154 as illustrated in FIGS. 17 and 18. As illustrated, as opposed to the embodiments illustrated in FIGS. 14-16, the second end 164 of the first piezoelectric actuator 152 is attached to the first end 168 of the compliant sheet 150 such that the angle $\theta_1$ between the first piezoelectric actuator 152 and the compliant sheet 150 is substantially less than 90°. Similarly, the second end 166 of the second piezoelectric actuator 154 is attached to the second end 170 of the compliant sheet 150 such that the angle $\theta_2$ between the second piezoelectric actuator 154 and the compliant sheet 150 is also substantially less than 90°.

Figure 19:
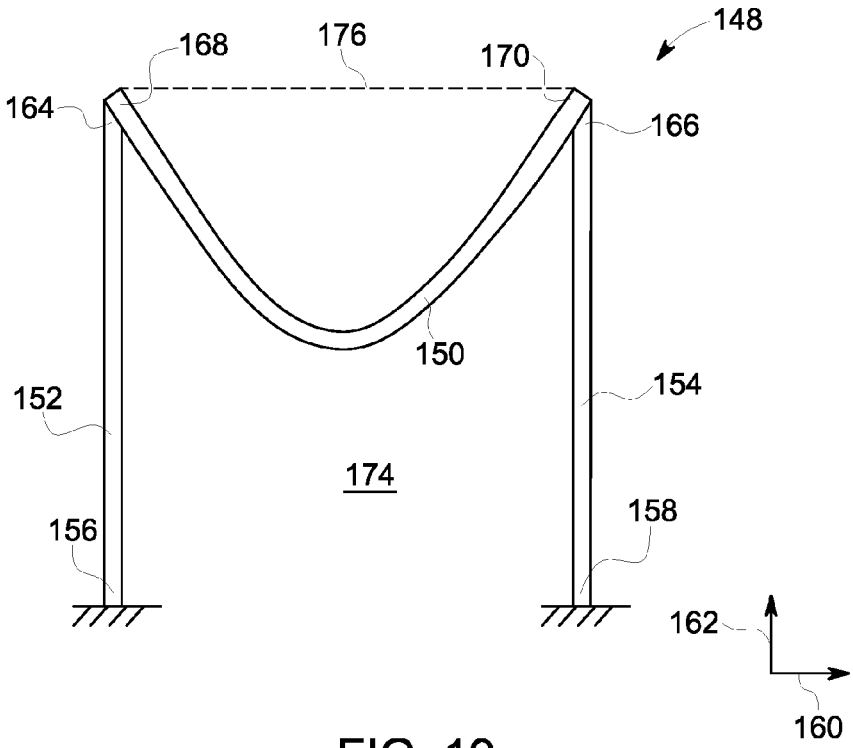
FIG. 19 is a sectional side view of the embodiment of the preloaded piezoelectric actuated assembly of FIG. 18 in a neutral position once the direct current has been removed from the first and second piezoelectric actuators.

Once the compliant sheet 150 has been rigidly attached to the first and second piezoelectric actuators 152, 154, the direct current being applied to the first and second piezoelectric actuators 152, 154 may be removed. Doing so allows the preloaded piezoelectric actuated assembly 148 to revert to a neutral position. For example, FIG. 19 is a sectional side view of the embodiment of the preloaded piezoelectric actuated assembly 148 of FIG. 18 in a neutral position once the direct current has been removed from the first and second piezoelectric actuators 152, 154. As illustrated, the neutral position for the preloaded piezoelectric actuated assembly 148 includes the compliant sheet 150 being deformed in such a way that the compliant sheet 150 is disposed between the first and second piezoelectric actuators 152, 154 within the space that was the interior volume 174 of the embodiment illustrated in FIGS. 14-16. In other words, the compliant sheet 150 of the preloaded piezoelectric actuated assembly 148 is predisposed toward the interior volume 174 of the preloaded piezoelectric actuated assembly 148 away from the state of minimum stress, which is illustrated in FIGS. 17 and 18.

Figure 20:
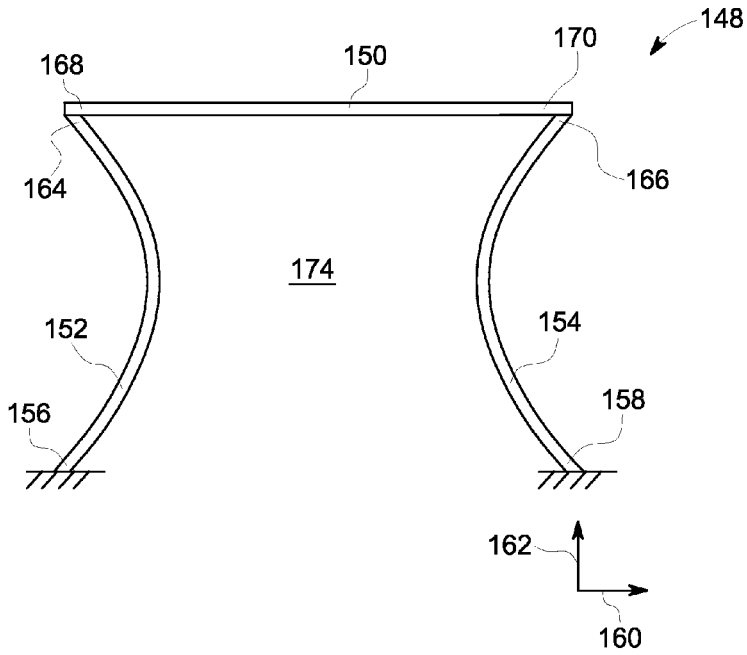
FIG. 20 is a sectional side view of the embodiment of the preloaded piezoelectric actuated assembly of FIG. 19 when the compliant sheet is in a first deformation state.
Figure 21:
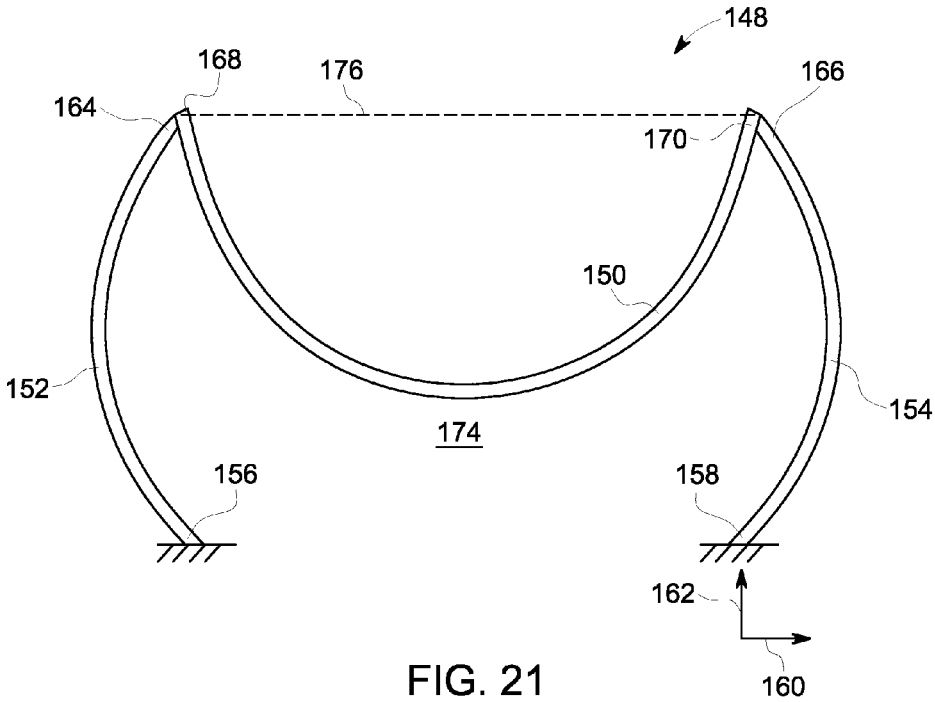
FIG. 21 is a sectional side view of the embodiment of the preloaded piezoelectric actuated assembly of FIG. 19 when the compliant sheet is in a second deformation state.

Therefore, when an alternating current is subsequently applied to the first and second piezoelectric actuators 152, 154, the compliant sheet 150 oscillates between two deformation states that are closer to the interior volume 174 that is at least partially defined by the compliant sheet 150 and the first and second piezoelectric actuators 152, 154. For example, FIG. 20 is a sectional side view of the embodiment of the preloaded piezoelectric actuated assembly 148 of FIG. 19 when the compliant sheet 150 is in a first deformation state, and FIG. 21 is a sectional side view of the embodiment of the preloaded piezoelectric actuated assembly 148 of FIG. 19 when the compliant sheet 150 is in a second deformation state. As illustrated in FIG. 20, in certain embodiments, the first deformation state may include the compliant sheet 150 being relatively closer (and, in certain embodiments, generally parallel) to the imaginary line 176 that connects the first and second ends 168, 170 of the compliant sheet 150 (or the respective second ends 164, 166 of the first and second piezoelectric actuators 152, 154). As such, in circumstances where space constraints exist, preloading the compliant sheet 150 toward the interior volume 174 may prove particularly beneficial.

Figure 22:
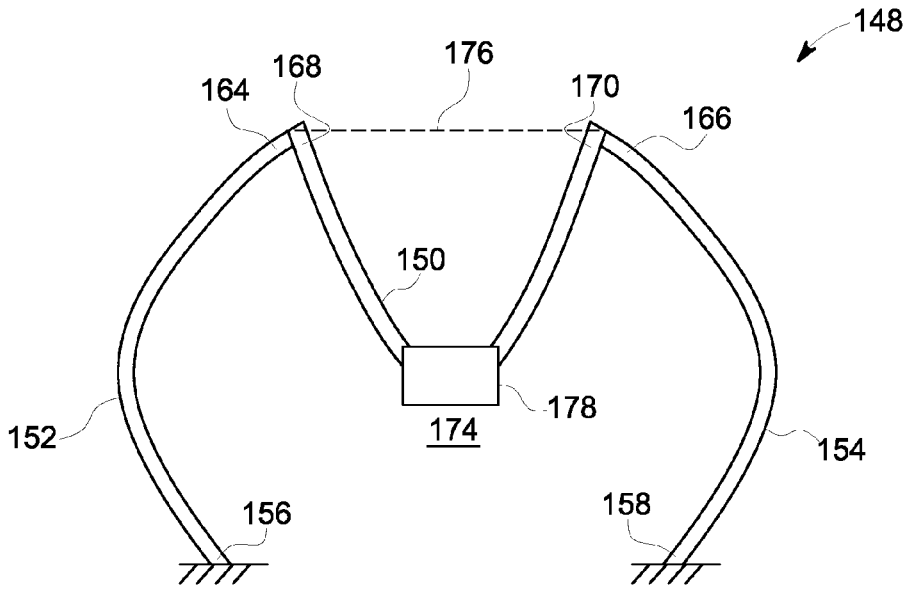
FIG. 22 is a sectional side view of an embodiment of a weighted piezoelectric actuated assembly that uses additional weight that has been added to the compliant sheet and is in a first deformation state.
Figure 23:
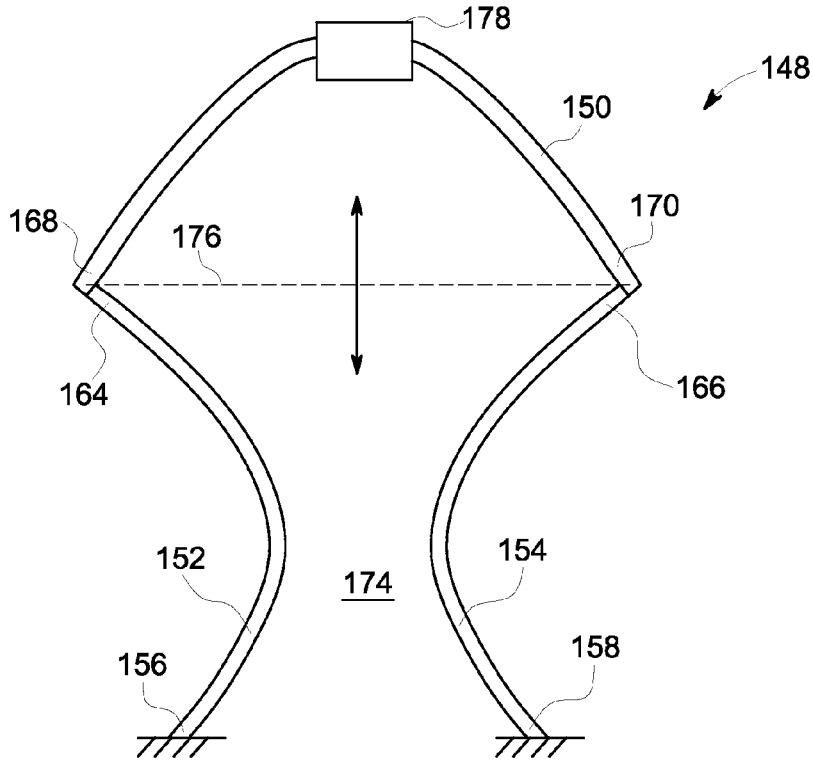
FIG. 23 is a sectional side view of the embodiment of the weighted piezoelectric actuated assembly of FIG. 22 in a second deformation state.

As described above, actuating the compliant sheet 150 with the first and second piezoelectric actuators 152, 154 may lead to greater maximum deflections than would otherwise be possible by simply exciting a piezoelectric membrane. In addition, in certain embodiments, additional weight may be added to the compliant sheet 150 to further increase the maximum deflection possible in the compliant sheet 150 due to the additional inertia created by the additional weight. For example, FIG. 22 is a sectional side view of an embodiment of a weighted piezoelectric actuated assembly 148 that uses additional weight 178 that has been added to the compliant sheet 150 and is in a first deformation state, and FIG. 23 is a sectional side view of the embodiment of the weighted piezoelectric actuated assembly 148 of FIG. 22 in a second deformation state. Although illustrated in FIGS. 22 and 23 as a single weight 178 attached at a midpoint of the compliant sheet 150, in other embodiments, one or more weights may be added to the compliant sheet 150, and the one or more weights may be spaced along the compliant sheet 150 in any appropriate manner to create deflections of the compliant sheet 150 that lead to appropriate volume displacements of air from the interior volume 174 through, for example, the synthetic jets described above.

The additional weight(s) 178 provide a means for adjusting the natural frequency of the weighted piezoelectric actuated assembly 148 through the general equation: $\omega=\sqrt{k/m}$, where $\omega$ is the natural frequency, k is the spring constant, and m is the mass. In other embodiments, other means for affecting the amount of deformation of the compliant sheet 150 may be used (e.g., springs, electric forces, magnetic forces, pressurized fluid on a back side, and so forth) to adjust the value of the spring constant k, such that the natural frequency of the weighted piezoelectric actuated assembly 148 is also adjusted. These other forces may be used as alternatives to, or as supplemental forces for, the additional weight(s) 178 illustrated in FIGS. 22 and 23.

Figure 24:
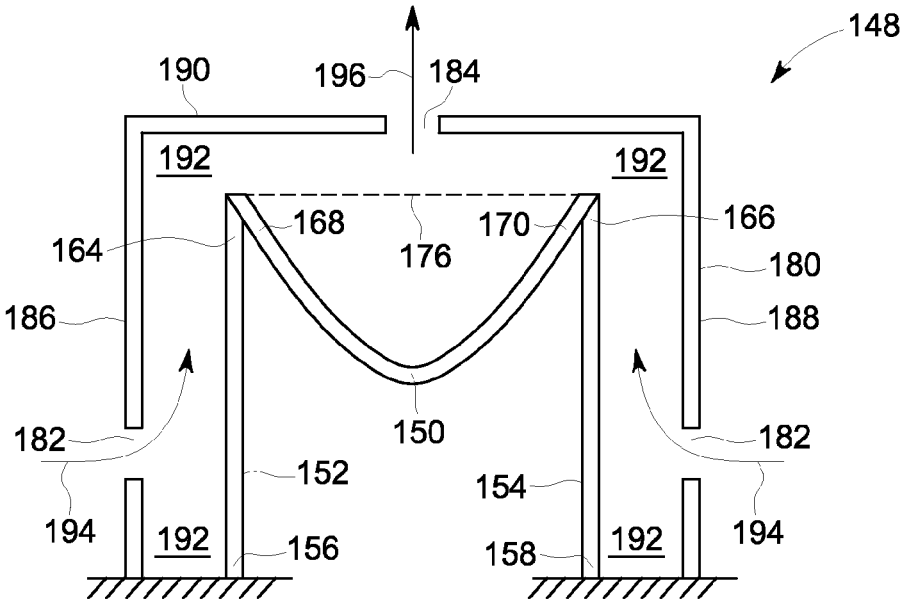
FIG. 24 is a sectional side view of an embodiment of the preloaded piezoelectric actuated assembly described above with respect to FIGS. 17-21 that is disposed within a housing having at least one air inlet opening and at least one air outlet opening.

In certain embodiments, the piezoelectric actuated assembly 148 described above with respect to FIGS. 14-23 may be designed such that the interior volume 174 is at least partially defined by the compliant sheet 150 and the first and second piezoelectric actuators 152, 154. However, in other embodiments, a separate housing or enclosure may be used to define the interior volume. For example, FIG. 24 is a sectional side view of an embodiment of the preloaded piezoelectric actuated assembly 148 described above with respect to FIGS. 17-21 that is disposed within a housing or enclosure 180 having at least one air inlet opening 182 and at least one air outlet opening 184. More specifically, the illustrated embodiment includes two air inlet openings 182 on opposite first and second lateral sides 186, 188 of the housing 180, wherein the first lateral side 186 is located proximate to the first piezoelectric actuator 152 and the second lateral side 188 is located proximate to the second piezoelectric actuator 154. In addition, the illustrated embodiment includes a single air outlet opening 184 in a top side 190 of the housing 180. As illustrated in FIGS. 20 and 21 above, as the alternating current is applied to the first and second piezoelectric actuators 152, 154, the compliant sheet 150 will oscillate between a first deformation state (e.g., illustrated in FIG. 20) and a second deformation state (e.g., illustrated in FIG. 21), thereby causing air to flow through an interior volume 192 defined between the enclosure 180 and the compliant sheet 150 and associated first and second piezoelectric actuators 152, 154, as illustrated by air inlet arrows 194 and air outlet arrow 196.

Figure 25:
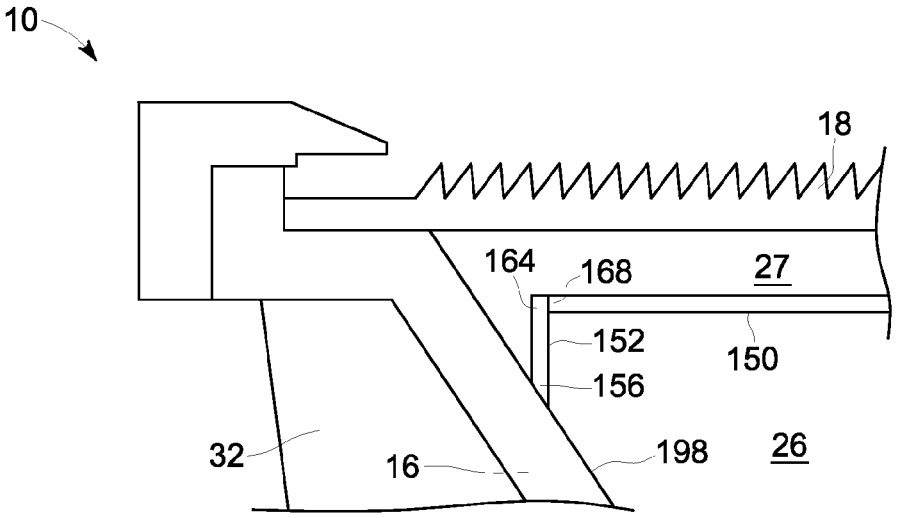
FIG. 25 is a partial sectional side view of an embodiment of the directional lamp of FIG. 1 taken within line 25-25, which utilizes a piezoelectric actuated assembly as described above with respect to FIGS. 14-24.

The embodiments of the piezoelectric actuated assemblies 148 illustrated in FIGS. 14-24 may be applied to any of the embodiments described above with respect to FIGS. 1-12. For example, all of the embodiments with respect to lamps as described above with respect to FIGS. 1-8 and 10-12, and the embodiment of the electronic component assembly of FIG. 9 may all utilize the techniques described with respect to the piezoelectric actuated assemblies 148 of FIGS. 14-24. As an example, FIG. 25 is a partial sectional side view of an embodiment of the directional lamp 10 of FIG. 1 taken within line 25-25, which utilizes a piezoelectric actuated assembly 148 as described above with respect to FIGS. 14-24. In the illustrated embodiment, the first piezoelectric actuator 152 is equivalent to the transducer 22 illustrated in FIG. 1 and the compliant sheet 150 is equivalent to the optical membrane 20 of FIG. 1. As such, as described above, the compliant sheet 150 may be made of a material that is substantially transparent or translucent. Although illustrated as being aligned generally orthogonal to the plane of the compliant sheet 150, in other embodiments, the first piezoelectric actuator 152 may be aligned generally orthogonal to a surface 198 of the collecting reflector 16. Furthermore, as the directional lamp 10 of FIG. 1 is circular, extending a full 360 degrees around, the piezoelectric actuated assembly 148 illustrated in FIG. 25 may not actually have first and second piezoelectric actuators 152, 154 as described herein, but rather may include either a single piezoelectric actuator that extends 360 degrees around the directional lamp 10, or a discrete number of piezoelectric actuators generally equally spaced around the directional lamp 10.

Furthermore, the piezoelectric actuated assemblies 148 of FIGS. 14-24 may be implemented in other embodiments illustrated in FIGS. 1-12. For example, in certain embodiments, the compliant sheet 150 may be the integrated lens and optical membrane 20' illustrated in FIG. 3, or the reflective optical membrane 20" illustrated in FIG. 4, in each case the transducers 22', 22'" being the piezoelectric actuators of FIGS. 14-24. In other embodiments, the compliant sheet 150 may be the top wall 42 of the panel lamp of FIG. 5, with the transducer 44 being a piezoelectric actuator of FIGS. 14-24. In other embodiments, the compliant sheet 150 may be the membrane 112 of the electrical component assembly of FIG. 9, with the transducers 114 being the piezoelectric actuators of FIGS. 14-24.

Indeed, the above detailed descriptions of embodiments of the invention are not intended to be exhaustive or to limit the invention to the precise form disclosed above. Although specific embodiments of, and examples for, the invention are described above for illustrative purposes, various equivalent modifications are possible within the scope of the invention, as those skilled in the relevant art will recognize. For example, while steps are presented in a given order, alternative embodiments may perform steps in a different order. The various embodiments described herein may also be combined to provide further embodiments.

From the foregoing, it will be appreciated that specific embodiments of the invention have been described herein for purposes of illustration, but well-known structures and functions have not been shown or described in detail to avoid unnecessarily obscuring the description of the embodiments of the invention. Where the context permits, singular or plural terms may also include the plural or singular term, respectively.

Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the term "comprising" is used throughout to mean including at least the recited feature (s) such that any greater number of the same feature and/or additional types of other features are not precluded. It will also be appreciated that specific embodiments have been described herein for purposes of illustration, but that various modifications may be made without deviating from the invention.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An apparatus, comprising:

at least one electronic component;

an enclosure enclosing the at least one electronic component, the enclosure including at least one wall defined by a membrane;

an electromechanical transducer, wherein the electromechanical transducer comprises:

a first piezoelectric actuator, a first end of which is fixed and a second end of which is rigidly attached to a first end of the membrane; and a second piezoelectric actuator, a first end of which is fixed and a second end of which is rigidly attached to a second end of the membrane, wherein application of alternating current to the first and second piezoelectric actuators generates a pulsating mechanical deformation of the membrane; and one or more openings in the enclosure for facilitating volume displacement of air from within the enclosure, wherein the volume displacement of air is provided by the pulsating mechanical deformation of the membrane.

2. The apparatus of claim 1, wherein the at least one electronic component comprises at least one light emitting diode (LED) device.

3. The apparatus of claim 2, wherein the membrane is an optical membrane comprising a transparent or translucent optical diffuser.

4. The apparatus of claim 2, wherein the membrane is an optical membrane comprising a wavelength converting element including at least one phosphor compound.

5. The apparatus of claim 2, wherein the membrane is an optical membrane comprising a refractive lens.

6. The apparatus of claim 2, wherein the membrane is an optical membrane comprising a reflective surface.

7. The apparatus of claim 1, wherein the at least one electronic component comprises:

a circuit board; and a plurality of electronic devices disposed on the circuit board, the electronic devices being selected from a group consisting of integrated circuit (IC) devices and discrete electronic devices.

8. The apparatus of claim 1, wherein the volume displacement of air provided by the pulsating mechanical deformation of the membrane and a size of the one or more openings are selected such that the volume displacement of air provided by the pulsating mechanical deformation of the membrane produces at least one synthetic jet arranged to provide active cooling of the at least one electronic component.

9. The apparatus of claim 1, wherein the electromechanical transducer is configured to generate the pulsating mechanical deformation of the membrane in which frequency components of the pulsating mechanical deformation at frequencies higher than 1500 Hz comprise no more than 10% of the total amplitude of the pulsating mechanical deformation.

10. The apparatus of claim 1, wherein the electromechanical transducer is configured to generate the pulsating mechanical deformation of the membrane at a dominant frequency of less than 100 Hz.

11. The apparatus of claim 1, wherein the enclosure comprises the membrane as a tubular membrane.

12. A piezoelectric actuated assembly, comprising:

a first piezoelectric actuator a first end of which is fixed;

a second piezoelectric actuator a first end of which is fixed; and a compliant sheet having a first end that is rigidly attached to a second end of the first piezoelectric actuator, and a second end that is rigidly attached to a second end of the second piezoelectric actuator;

wherein application of alternating current to the first and second piezoelectric actuators generates a pulsating mechanical deformation of the compliant sheet.

13. The piezoelectric actuated assembly of claim 12, wherein the compliant sheet is preloaded such that the compliant sheet is deformed away from a state of minimum stress when the alternating current is not applied to the first and second piezoelectric actuators.

14. The piezoelectric actuated assembly of claim 12, comprising an additional weight attached to the compliant sheet.

15. The piezoelectric actuated assembly of claim 12, comprising an enclosure disposed around the compliant sheet and the first and second piezoelectric actuators.

16. The piezoelectric actuated assembly of claim 15, wherein the enclosure comprises at least one opening, wherein a volume displacement of air is provided through the piezoelectric actuated assembly via the at least one opening by the pulsating mechanical deformation of the compliant sheet.

17. The piezoelectric actuated assembly of claim 12, wherein the compliant sheet comprises an optical membrane of a solid state lighting device.

18. The piezoelectric actuated assembly of claim 12, wherein the compliant sheet comprises a wall of an enclosure surrounding at least one electronic component.

19. An apparatus, comprising:

at least one electronic component;

an enclosure enclosing the at least one electronic component, the enclosure including at least one wall defined by a membrane; and an electromechanical transducer, wherein the electromechanical transducer comprises:

a first piezoelectric actuator, a first end of which is fixed and a second end of which is rigidly attached to a first end of the membrane; and a second piezoelectric actuator, a first end of which is fixed and a second end of which is rigidly attached to a second end of the membrane, wherein application of alternating current to the first and second piezoelectric actuators generates a pulsating mechanical deformation of the membrane.

* * * * *